US006770240B1

(12) United States Patent
Laird et al.

(10) Patent No.: US 6,770,240 B1
(45) Date of Patent: Aug. 3, 2004

(54) SYSTEM AND METHOD FOR AIR EMBOSSING FABRICS UTILIZING IMPROVED AIR LANCES

(75) Inventors: William Laird, Warwick, RI (US); George Murphy, Franklin, MA (US)

(73) Assignee: Microfibres, Inc., Pawtucket, RI (US)

( * ) Notice: Subject to any disclaimer, the term of this patent is extended or adjusted under 35 U.S.C. 154(b) by 0 days.

(21) Appl. No.: 09/979,217

(22) PCT Filed: May 22, 2000

(86) PCT No.: PCT/US00/13993

§ 371 (c)(1),
(2), (4) Date: Mar. 8, 2002

(87) PCT Pub. No.: WO00/71802

PCT Pub. Date: Nov. 30, 2000

Related U.S. Application Data

(60) Provisional application No. 60/135,379, filed on May 21, 1999.

(51) Int. Cl.[7] ..... D06C 23/00

(52) U.S. Cl. ..... 264/546; 26/2 R; 28/160; 264/555; 425/385

(58) Field of Search ..... 264/546, 555; 425/385; 26/2 R; 28/160

(56) References Cited

U.S. PATENT DOCUMENTS

| | | | |
|---|---|---|---|
| 774,890 | A | 11/1904 | Mutterer |
| 1,802,547 | A | 4/1931 | Allen |
| 1,810,328 | A | 6/1931 | Slater |
| 1,883,535 | A | 10/1932 | Burnett |
| 1,912,625 | A | 6/1933 | Dreyfus |
| 2,076,451 | A | 4/1937 | Fallscheer |
| 2,182,321 | A | 12/1939 | Rivat |
| 2,217,113 | A | 10/1940 | Hardy |
| 2,221,232 | A | 11/1940 | Clavel et al. |
| 2,255,615 | A | 9/1941 | Frankel |
| 2,302,020 | A | 11/1942 | Frederick, Jr. |
| 2,303,202 | A | 11/1942 | Faris et al. |
| 2,311,850 | A | 2/1943 | Mantell |
| 2,366,926 | A | 1/1945 | Melton |
| 2,368,706 | A | 2/1945 | Fountain |
| 2,384,951 | A | 9/1945 | Millar |

(List continued on next page.)

FOREIGN PATENT DOCUMENTS

| | | |
|---|---|---|
| CA | 2024768 | 3/1991 |
| CA | 2084535 | 10/1993 |
| DE | 3419367 A1 | 11/1984 |
| EP | 0507028 A1 | 10/1992 |
| FR | 2346162 | 10/1977 |
| WO | WO 00/71802 A1 | 11/2000 |
| WO | WO 01/21878 A1 | 3/2001 |
| WO | WO 02/12608 A2 A3 | 2/2002 |

*Primary Examiner*—James P. Mackey
(74) *Attorney, Agent, or Firm*—Wolf, Greenfield & Sacks, P.C.

(57) ABSTRACT

Air embossing systems, air lances and methods of air embossing fabrics produce fine detail, crisp transition between unembossed and embossed regions, and a high degree of uniformity across the width of an embossed fabric. The air embossing systems utilize air lances (210) for directing a stream of air onto the embossable surface (113) of a fabric (111) that have at least one nozzle (216) having an orifice dimension substantially less than that of conventional nozzles. The air embossing systems can also include air lance nozzles positioned in proximity to the embossable surface, nozzles with an orifice dimension that is substantially less than the nozzle length, nozzles in the shape of an elongated slit oriental across essentially the entire width of the fabric, air lances including a nozzle-forming component (214) separable from the main body (212) of the air lance to enable the nozzle to be positioned within close proximity to the fabric and to redirect air to be emitted such that a substantial fracti n of the air stream is directed perpendicular to the fabric surface, and air lances including baffles r air redirecting elements (340) which deflect air to pass through the nozzle and nt the fabric surface at an increased angle, relative to the air lance longitudinal axis.

97 Claims, 17 Drawing Sheets

U.S. PATENT DOCUMENTS 2,491,316 A 12/1949 Kirk
2,563,259 A 8/1951 Miller
2,642,835 A 6/1953 Winkel
2,687,384 A 8/1954 Weisberg
2,766,720 A 10/1956 Müller et al.
2,774,126 A 12/1956 Secrist
2,848,974 A 8/1958 Lee III
2,900,278 A 8/1959 Powers et al.
2,907,721 A 10/1959 Auer
2,981,224 A 4/1961 Phelps
3,050,415 A 8/1962 Brown
3,079,212 A 2/1963 Fountain et al.
3,339,525 A 9/1967 Roberts
3,508,523 A 4/1970 De Meerleer
3,916,823 A 11/1975 Halloran
3,958,507 A 5/1976 Mitter
4,255,150 A 3/1981 Fennekels et al.
4,444,104 A 4/1984 Mitter
4,497,095 A 2/1985 Minemura et al.
4,497,249 A 2/1985 Mitter
4,499,637 A 2/1985 Greenway
4,612,874 A 9/1986 Mitter
5,122,219 A 6/1992 Ludwig
5,148,583 A 9/1992 Greenway
5,202,077 A 4/1993 Marco et al.
5,400,485 A 3/1995 Bialostozky-Krichevsky
5,510,143 A 4/1996 Walsh et al.
5,861,044 A 1/1999 Crenshaw
2002/0043162 A1 4/2002 Laird et al.

SYSTEM AND METHOD FOR AIR EMBOSSING FABRICS UTILIZING IMPROVED AIR LANCES

RELATED APPLICATIONS

This application is a national stage filing under 35 U.S.C. §371 of PCT International Application No. PCT/US00/13993 filed May 22, 2000, which was published under PCT Article 21(2) in English. PCT International Application No. PCT/US00/13993 claims the benefit under 35 U.S.C. §119 (e) of U.S. provisional patent application serial No. 60/135,379 filed May 21, 1999.

FIELD OF THE INVENTION

The present invention relates to systems and methods for embossing a surface of an embossable fabric with a stream of air, and embossed flocked fabrics made thereby.

BACKGROUND OF THE INVENTION

In manufacturing flocked fabric it is conventional to deposit a layer of flock on an adhesive coated substrate and to emboss the surface of the flocked fabric during this process with selected designs. Conventionally, the embossing process may be achieved by one of several processes using specialized equipment for such purposes. Among these embossing processes is air embossing. In the air embossing process a substrate is coated with an adhesive. While the adhesive is still wet it is covered with a layer of flock fibers forming the flocked layer. The adhesive coated substrate with the flocked fibers is then carried beneath a stencil while the adhesive is not yet set. The stencil under which the assembly moves typically comprises an elongated cylinder having perforations arranged in a desired pattern to be formed in the flocked surface. This embossing stencil typically is rotated at the same speed as the flocked layer moves beneath it. Air introduced within this cylindrical stencil is directed downwardly through the perforations forming the pattern onto the upper surface of the flocked layer. By choosing a particular arrangement of perforations in the screen, and by the selective application of air flow through the perforations, air jets are projected downwardly from the stencil onto the surface of the flocked fabric. Since the flocked fabric has not yet set in the adhesive, the stream of air changes the angle of or substantially flattens the flock fibers forming the flock in selected areas, thus forming a pattern as the stencil rotates and the flocked fabric moves.

A variety of prior art systems are available for performing air embossing of flocked fabrics. Many such systems are generally satisfactory for embossing designs onto an embossable surface of the fabric that do not require a significant level of fine detail. However, typical prior art systems suffer from a variety of shortcoming which limit their utility for producing finely detailed patterns, and which result in embossed pile fabrics that include embossed regions having undesirable artifacts and visually unappealing surface features. For example, air embossed pile fabrics produced with conventional air embossing equipment are typically not able to produce embossed features having a characteristic size that is very small, thus such equipment is not able to give the embossed fabric an appearance with a fine, detailed surface structure. In addition, typical prior art air embossing systems are not able to direct air towards the embossable surface of the fabric at a controlled, desirable angle (e.g. essentially perpendicular to the fabric surface), and, thus, they tend to produce embossed features having a blurred or imprecise transition region between the embossed features and the unembossed regions of the surface, which results in an associated lack of crispness and definition to the overall appearance of the embossed fabric.

In addition, typical prior art air embossing systems also tend to produce embossed fabrics having embossed features distributed across the width of the fabric that are not uniform in appearance across the width of the fabric. Also, typical prior art air embossing systems have a tendency to direct air towards the surface of the fabric in a direction diagonal to the fabric surface resulting in an embossed surface wherein the pile fibers have an overall directional lay with respect to the substrate, thus creating a distorted, unattractive appearance in the embossed surface, which appearance does not accurately reflect the pattern provided in the stencil used for embossing.

The present invention is directed to improved air embossing systems and methods and improved embossed fabrics produced using the systems and methods. The invention provides a variety of air embossing systems utilizing improved air lances for directing air onto and through a patterned stencil of the system. The improved air lances and embossing systems provided by the invention are able, in many embodiments, to solve many of the above-mentioned short comings of prior art air embossing systems and to produce embossed fabrics having an unprecedented level of fine detail, crisp transition between unembossed and embossed regions, and uniformity across the width of the embossed fabric.

SUMMARY OF THE INVENTION

The present invention provides, in some embodiments, improved air embossing systems, improved air lances, and improved methods of air embossing fabrics, which are able to produce an unprecedented level of fine detail, crisp transition between unembossed and embossed regions, and a high degree of uniformity across the width of an embossed fabric, when compared to the performance of typical, conventional air embossing systems, air lances, and embossing methods. The air embossing systems provided by the invention, in some embodiments, utilize air lances for directing a stream of air onto the embossable surface of a fabric that have at least one nozzle having a characteristic orifice dimension substantially less than that of conventional air lance nozzles. The disclosed air embossing systems can also include air lances having nozzles positioned in close proximity to the embossable surface of a fabric being embossed, substantially closer than is typical for air lances employed in conventional air embossing systems. Air lances provided according to the invention can also include one or more nozzles having a characteristic orifice dimension that is substantially less than a characteristic length of the nozzles. Certain air lances provided according to the invention can also include one or more nozzles in the shape of an elongated slit oriented, with respect to the air lance, so as to be positioned across essentially the entire width of a fabric being embossed with the air lance. The invention also provides air lances for use in embossing fabrics that can include a nozzle-forming component that is separable from the main body of the air lance and that enables the nozzle(s) of the air lance to be positioned within close proximity to the fabric, when the air lance is in operation, and that also can act to redirect air flowing within the air lance such that it is emitted from the nozzle(s) so that a substantial fraction of the air stream is directed essentially perpendicular to the surface of the fabric being embossed. Yet other air lances disclosed include therein one or more baffles or air redirecting elements, which serve to deflect air flowing within the air lance so that it passes through the nozzle(s) and is directed onto the embossable surface of the fabric at an angle that is substantially greater, with respect to the longitudinal axis of the air lance, than the angle of an air stream emitted from a nozzle of an essentially equivalent air lance, except excluding the air redirecting element or baffle. Some of the air lances described according to the invention can include a combination of several or all of the above described features.

In one embodiment, a system for air embossing a surface of an embossable fabric is disclosed. The system comprises a stencil having a first surface and a second, fabric-facing surface that is positionable adjacent and in spaced proximity to the embossable surface of the fabric during air embossing. The system further comprises an air lance comprising a main body portion and including at least one nozzle. The nozzle is constructed and positioned to direct a stream of air through at least one opening in the stencil and onto the embossable surface. The air lance is secured within the system to maintain the nozzle in a fixed, predetermined position relative to the first surface of the stencil during operation. The air lance is positioned such that the nozzle is positioned so that at least a portion thereof, which is closest to the stencil, is separated from the first surface of the stencil by a first distance, when the system is in operation. The air lance is also positioned such that the smallest distance separating the main body portion of the air lance from the first surface of the stencil exceeds the first distance.

In another embodiment, a system for air embossing a surface of an embossable fabric is disclosed. The system comprises a stencil and an air lance including at least one nozzle thereon. The nozzle is constructed and positioned to direct a flow of air through the stencil and onto the embossable surface of the fabric, when the system is in operation. The system further comprises a substantially smooth support surface comprising a cylindrical roller constructed and arranged to support the underside of the fabric during air embossing of the embossable surface of the fabric with the system. The cylindrical roller is positioned directly beneath and spaced apart from the nozzle such that a stream of air exiting the nozzle is directed to impinge upon the fabric at a location where the fabric is adjacent to and in contact with the cylindrical roller, when the system is in operation.

In another aspect, an air lance for directing air through a stencil and onto a surface of an embossable fabric for air embossing the fabric is disclosed. The air lance comprises a conduit having at least one opening therein and at least one orifice forming at least one nozzle. The nozzle is constructed and positioned to direct a stream of air through the stencil and onto the embossable surface of the fabric when the air lance is in operation. The nozzle has a characteristic orifice dimension not exceeding about 0.05 inch.

In another embodiment, an air lance for directing air through a stencil and onto a surface of an embossable fabric for air embossing the fabric is disclosed. The air lance comprises a conduit having at least one inlet opening therein and at least one orifice forming at least one nozzle. The nozzle is constructed and positioned to direct a stream of air through the stencil and onto the embossable surface of the fabric when the air lance is in operation. The nozzle has a characteristic orifice dimension not exceeding a maximum characteristic length of the nozzle.

In yet another embodiment, an air lance for directing air through a stencil and onto a surface of an embossable fabric for air embossing the fabric is disclosed. The air lance comprises a conduit having an elongated main body portion with at least one inlet opening and at least one outlet opening therein. The air lance further includes a nozzle-forming component connected to the main body portion and extending along a substantial fraction of the length of the main body portion. The nozzle-forming component includes at least one orifice therein forming a nozzle. The nozzle is in fluid communication with the outlet opening of the main body portion and is constructed and positioned to direct a stream of air through at least one opening in the stencil and onto the embossable surface of the fabric when the air lance is in operation. The nozzle-forming component is shaped and positioned so that the nozzle in the nozzle-forming component is separated from a first surface of the stencil onto which air is impinged by a distance that is substantially less than a distance separating the first surface of the stencil and the outlet opening in the main body portion of the conduit.

In yet another embodiment, an air lance for directing air through a stencil and onto a surface of an embossable fabric for air embossing the fabric is disclosed. The air lance comprises an elongated tubular conduit having at least one inlet opening therein and at least one internal support strut attached therein. The support strut is constructed and positioned within the conduit to resist expansion of the conduit when the air lance is in operation. The air lance includes at least one orifice in the shape of an elongated slit forming at least one nozzle. The nozzle is constructed and positioned to direct a stream of air through at least one opening in the stencil and onto the embossable surface of the fabric, when the air lance is in operation.

In another embodiment, an air lance for directing air through a stencil onto a surface of an embossable fabric for air embossing the fabric is disclosed. The air lance comprises a conduit having at least one opening therein and at least one orifice forming at least one nozzle. The nozzle is constructed and positioned to direct a stream of air through at least one opening in the stencil and onto the embossable surface of the fabric when the air lance is in operation. The air lance further comprises at least one air redirecting element constructed and positioned with respect to the nozzle so that the fractional amount of the stream of air directed through the opening in the stencil essentially perpendicular to the embossable surface of the fabric is increased with respect to a fractional amount of a stream of air directed through the opening in the stencil essentially perpendicular to the embossable surface of the fabric by an essentially equivalent air lance, except not including the air redirecting element.

In another aspect, a method for air embossing a surface of an embossable fabric is disclosed. The method comprises supplying a flow of air to an air lance and flowing a stream of air through at least one nozzle of the air lance so that essentially the entire stream of air is directed towards a surface of a stencil facing and adjacent the nozzle at an angle of at least about 45 degrees with respect to a longitudinal axis of the air lance. The method further comprises passing the stream of air through at least one opening in the stencil and impinging the stream of air onto the embossable surface of the fabric, thereby embossing the embossable surface of the fabric.

In another embodiment, a method for air embossing a surface of an embossable fabric is disclosed. The method comprises supplying a flow of air to an elongated air lance including one or more nozzles positioned along a substantial fraction of the length of the air lance. The method further comprises flowing a stream of air through the one or more nozzles such that the air velocity through the one or more nozzles is essentially constant along the substantial fraction of the length of the air lance. The method further includes passing the stream of air through at least one opening in the stencil and impinging the stream of air onto the embossable surface of the fabric, thereby embossing the embossable surface of the fabric.

In yet another embodiment, a method for embossing a surface of an embossable fabric is disclosed. The method comprises supplying a flow of air to an air lance, flowing a stream of air through at least one nozzle of the air lance so that the velocity of the air exiting the nozzle is at least about 12,000 ft/min, passing the stream of air through at least one opening in the stencil, impinging the stream of air onto the embossable surface of the fabric, and embossing the embossable surface of the fabric with a predetermined pattern of embossed features.

In another embodiment, a method for air embossing a surface of an embossable fabric is disclosed. The method comprises supplying a flow of air to an air lance, flowing a stream of air through at least one nozzle of the air lance, rotating a cylindrical stencil disposed around at least a portion of the air lance at a first speed, passing the stream of air through at least one opening in the rotating stencil, moving the fabric adjacent to an outer surface of the stencil at a second speed that is different from the first speed of the rotating stencil, impinging the stream of air onto the embossable surface of the fabric, and embossing the embossable surface of the fabric with a predetermined pattern of embossed features.

In another embodiment, a method for air embossing a surface of an embossable fabric is disclosed. The method comprises positioning at least a portion of at least one nozzle of an air lance within a first separation distance from a first surface of a stencil, positioning a main body portion of the air lance so that the smallest distance separating the main body portion from the first surface of the stencil exceeds any distance separating the nozzle from the first surface of the stencil, forming a stream of air with the air lance by passing air through the nozzle of the air lance, and directing the stream of air through at least one opening in the stencil and onto the embossable surface of the fabric to form a predetermined pattern of embossed features.

In yet another embodiment, a method for air embossing a surface of an embossable fabric is disclosed. The method comprises positioning a substantially smooth support surface comprising a cylindrical roller directly beneath and spaced apart from the nozzle of the air lance. The method further comprises supporting the underside of the embossable fabric with the cylindrical roller and directing a stream of air with the nozzle through a stencil and onto the embossable surface of the fabric such that the stream of air impinges upon the fabric at a location where the fabric is adjacent to and in contact with the cylindrical roller.

In yet another embodiment, a method for air embossing a surface of an embossable fabric is disclosed. The method comprises directing a stream of air though a stencil and onto the embossable surface of the fabric with an air lance including a conduit, having at least one inlet opening therein, and at least one orifice forming at least one nozzle having a characteristic orifice dimension not exceeding about 0.05 inch.

In another embodiment, a method for air embossing a surface of an embossable fabric is disclosed. The method comprises directing a stream of air through a stencil and onto the embossable surface of the fabric with an air lance including a conduit, having at least one inlet opening therein, and at least one orifice forming at least one nozzle having a characteristic orifice dimension not exceeding a maximum characteristic length of the nozzle.

In yet another embodiment, a method for air embossing a surface of an embossable fabric is disclosed. The method comprises directing a stream of air through a stencil an onto the embossable surface of the fabric with an air lance including a conduit, and a nozzle forming component including at least one orifice therein forming a nozzle that is in fluid communication with the outlet opening in the main body portion. The nozzle forming component is shaped and positioned to extend along a substantial fraction of the length of the main body portion and so that the nozzle in the nozzle forming component is separated from a first surface of the stencil, onto which the stream of air is impinged, by a distance that is substantially less than a distance separating the first surface of the stencil and the outlet opening in the main body portion of the conduit.

In another aspect, in a system for air embossing an embossable fabric, means are disclosed for directing a stream of air onto the embossable surface of the fabric from a distance of no more than about 0.75 inch, with at least one cross-sectional dimension of the air stream being no more than about 0.2 inch at its source.

In yet another aspect, an air embossing system for embossing a surface of an embossable fabric is disclosed. The air embossing system comprises an elongated conduit extending across and substantially parallel to the embossable fabric and further includes means for redirecting air flowing along the length of the conduit so that essentially all of the air flow exits from at least one outlet opening in the conduit towards the fabric in a direction making an angle of at least about 45 degrees with respect to the longitudinal axis of the elongated conduit, with the means comprising a series of baffles shaped and positioned to intercept and deflect the air flow.

In another embodiment, a method for embossing a surface of an embossable fabric is disclosed. The method comprises directing a stream of air through a stencil and onto the embossable surface of the fabric with an air lance including an elongated tubular conduit. The conduit has at least one inlet opening therein, at least one internal support strut attached therein, which support strut is constructed and positioned within the conduit to resist expansion of the conduit when the air lance is in operation, and at least one orifice in the shape of an elongated slit forming at least one nozzle.

In yet another embodiment, a method for air embossing a surface of an embossable fabric is disclosed. The method comprises directing a stream of air through a stencil and onto the embossable surface of the fabric with an air lance including a conduit, the air lance having at least one inlet opening therein, at least one orifice forming at least one nozzle, and at least one air redirecting element constructed and positioned with respect to the nozzle so that the fractional amount of the stream of air directed through the stencil essentially perpendicular to the embossable surface of the fabric is increased with respect to a fractional amount of a stream of air directed through the stencil essentially perpendicular to the embossable surface of the fabric by an essentially equivalent air lance, except not including the air redirecting element.

Other advantages, novel features, and objects of the invention will become apparent from the following detailed description of the invention when considered in conjunction with the accompanying drawings, which are schematic and which are not intended to be drawn to scale. In figures, each identical, nearly identical, or closely similar component that is illustrated in various figures is represented by a single numeral. For purposes of clarity, not every component is labeled in every figure, nor is every component of each embodiment of the invention shown where illustration is not necessary to allow those of ordinary skill in the art to understand the invention.

DETAILED DESCRIPTION

Figure 1A:
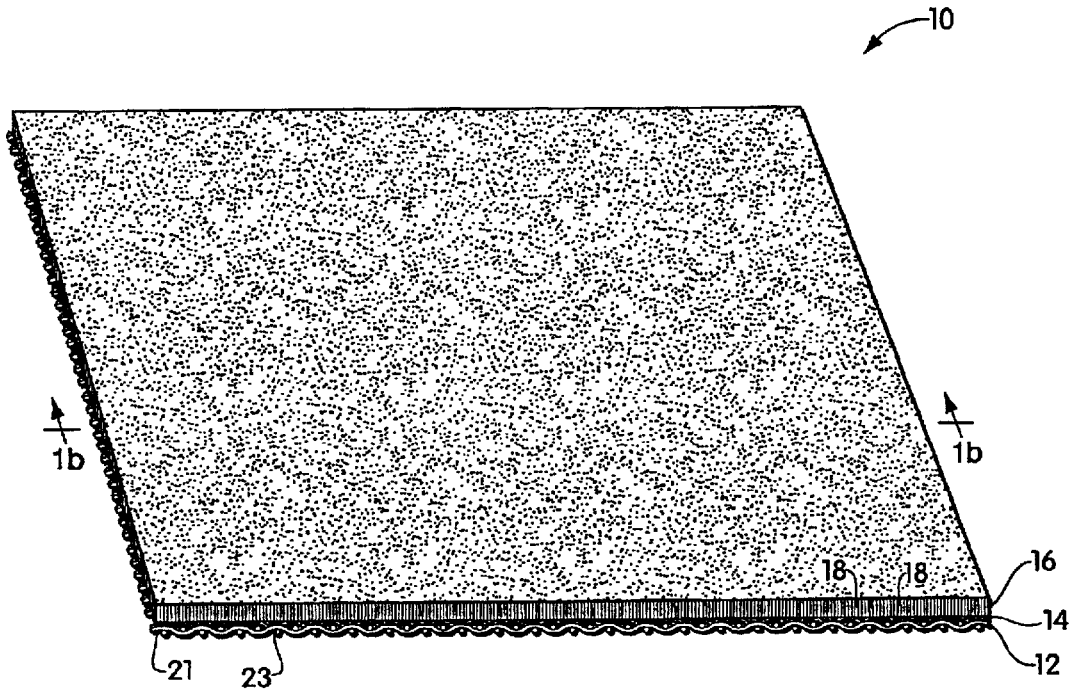
FIG. 1*a* is a schematic perspective view of an unembossed pile fabric.

The present invention provides a variety of improved air embossing systems and methods of operation of air embossing systems that are able to improve the performance of such systems and result in the production of embossed fabrics which have an unprecedented level of fine detail and uniformity to the embossed pattern. As will become more apparent from the detailed description below, an important factor in the performance of air embossing systems is the design and positioning of the air lance, which distributes air through a patterned stencil and onto the surface of the fabric, within the system. The present invention provides, in some embodiments, a variety of improved air lance designs and improved systems for positioning the air lance with respect to the stencil and fabric.

The present invention is directed to methods and systems for air embossing an embossable fabric. It should be understood that while the invention is described in the embodiments below in the context of embossable fabrics comprising flocked, pile fabrics, that the invention is not so limited and that an embossable fabric as used herein encompasses any fabric having at least one embossable surface. An "embossable surface" refers to a surface that can be permanently or temporarily visibly altered by an air stream impinging thereon. In addition, while the present invention is described as utilizing air for embossing an embossable surface of a fabric, it should be understood that other gases may be substituted for air, as would be apparent to those of ordinary skill in the art.

While in some embodiments the air embossing systems of the present invention may include an air lance directing a stream of air directly onto the embossable surface of an embossable fabric to form a pattern thereon, in preferred embodiments, the air stream from the air lance is directed through a stencil before impinging upon the surface of the fabric. A "stencil" as used herein defines a gas impermeable surface having a plurality of apertures therein oriented in a pattern on the surface. The air directed from the air lance onto the surface of the stencil, in such systems, is interrupted by the solid gas-impermeable stencil but passes freely through the openings or apertures within the stencil, thus forming an embossed pattern on the surface of the fabric dictated by the pattern of apertures within the stencil. Stencils for use according to the invention can comprise flat or cylindrical surfaces, and the surfaces may be stationary or movable with respect to the embossable surface of the fabric during operation of the air embossing system.

An "air lance" as used herein refers broadly to a conduit, manifold, or other object able to direct a stream of air onto the surface of a stencil and/or embossable fabric. In preferred embodiments, described in detail below, the air lance comprises an elongated conduit, extending across essentially the entire width of the fabric that is embossed by the system, which includes at least one nozzle for directing the stream of air. A "nozzle," as used herein, refers to the smallest orifice within the air lance through which an air stream passes. As shown in more detail below, some of the air lances provided according to the invention include a plurality of discrete nozzles therein, for example, a plurality of nozzles comprising individual holes within the air lance, each of which direct a stream of air toward the surface of an embossable fabric. In such embodiments, each of such holes comprises a "nozzle." For embodiments where the nozzles are not all of the same size, or where the air lance includes a nozzle having a characteristic dimension that is non-uniform along the length of the air lance, the "smallest orifice in the air lance through which an air stream passes," which defines a "nozzle", refers to the smallest orifice in the lance through which any portion or component of the air stream passes. In other words, for embodiments including a nozzle or nozzles that are non-uniform in size, as described above, the smallest orifice through which any given molecule or atom of the air stream passes before exiting the air lance comprises a "nozzle".

In preferred embodiments of the invention, the nozzle or nozzles within the air lance are constructed and positioned to direct a stream of air through at least one opening in a stencil and onto an embossable surface of the fabric. The term "constructed and positioned to direct a stream of air through at least one opening in a stencil and onto an embossable surface" of a fabric as used herein refers to the nozzle(s) being sized and positioned within the air embossing system such that at least a portion of an air stream emitted from the nozzle(s) is directed through an opening of the stencil and onto the embossable surface of the fabric.

Conventional prior art air lances utilized for air embossing fabrics typically comprise a long tubular conduit having a single row of holes extending lengthwise along the tube so that they traverse the width of the fabric when the air lance is positioned for use. The holes, comprising nozzles of the air lance, in prior art configurations, are typically relatively large in diameter (e.g., greater than about 0.25 inch in diameter). The open area in the air lance formed by the nozzles also, in conventional designs, is at least about 40% of the internal cross sectional area of the main body of the air lance. Also, in conventional air embossing systems, the nozzles are positioned spaced apart from the stencil through which the air is directed by a relatively large distance of at least about 1 inch.

The above-described conventional air lance designs are not well suited for producing finely detailed embossed patterns in fabrics, which patterns have a uniform visual appearance across the width of the embossed fabric. Such finely detailed embossed patterns in fabrics are highly desirable in the marketplace and are enabled and provided by the improved systems and methods according to the invention. The air lances and air embossing systems utilizing the air lances provided according to the invention include a variety of improvements over the above-described prior art system, which improvements, alone or in combination, can solve many of the above-mentioned problems inherent in the prior art systems.

For example, some embodiments of air embossing systems provided according to the invention include air lances that are designed so that the distance separating the nozzle(s) from the stencil is significantly less than for prior art systems. In combination with the above, or in other embodiments, the invention also provides air embossing systems with air lances having a nozzle(s) with a characteristic dimension smaller than typical prior art nozzle sizes. In combination with the above, or in other embodiments, air lances provided according to the invention can include a nozzle(s) having a total open area that is significantly smaller with respect to a cross-sectional area of a conduit comprising the main body of the air lance than for typical prior art air lances. In combination with the above, or in other embodiments, the invention also involves emitting an air stream from the nozzle(s) of the air lance at a velocity that is significantly higher than that created by conventional air embossing systems. In combination with the above, or in other embodiments, the air lances provided according to the invention also can include nozzle(s) formed in the shape of a continuous slit, as opposed to the discrete holes comprising nozzles typically included in conventional air lances. In combination with the above, or in other embodiments, the invention also provides air lances that can include air redirecting elements or baffles therein, and/or nozzles that are shaped to create more focused and collimated air flow therethrough when compared to conventional air lance nozzles.

Certain of the above-mentioned inventive features, when utilized alone or in combination with other of the above-mentioned features, or in combination with other inventive features of the air embossing systems described in more detail below, can solve many of the problems associated with typical prior art air embossing systems. For example, air embossing systems and air lances provided according to the invention can create, in some embodiments, a fabric embossing air steam having a high degree of collimation, a low degree of turbulence, and a high flow velocity, yielding better definition and more fine detail in fabric surfaces embossed with the inventive systems. The inventive systems, in some embodiments, also provide air lances which can emit an air stream having a more even and uniform air flow velocity distribution across the entire width of the air lance nozzle region than is achievable in typical prior art air lances. The inventive air embossing systems, in some embodiments, also can eliminate visible embossing artifacts present in an embossed fabric and created by the shape and configuration of typical air lance nozzle designs that are utilized in conventional air lances. In addition, some embodiments of air embossing systems according to the invention can eliminate or reduce visible embossing artifacts present in an embossed fabric surface and created by air impinging upon the surface of the fabric diagonally thereto, which creates an overall visual directionality of the surface and a resulting distortion of the embossed pattern, which is undesirable.

Those skilled in the art would readily appreciate that all parameters listed herein are meant to be exemplary and that the actual parameters for a given system or method will depend upon the specific application for which the methods and apparatuses of the present invention are used. It is, therefore, to be understood that the foregoing embodiments are presented by way of example only and that, within the scope of the appended claims and equivalents thereto, the invention may be practiced otherwise than as specifically described.

Figure 1B:
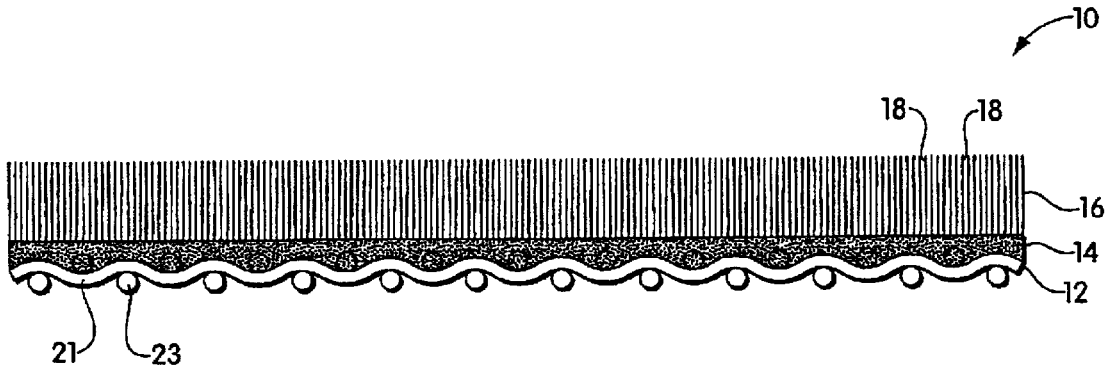
FIG. 1*b* is a cross-sectional schematic illustration of the pile fabric shown in FIG. 1*a;*

A conventional flocked fabric 10, which is unembossed, is shown in FIG. 1*a*, and in cross-section in FIG. 1*b*. The fabric is comprised of a substrate layer 12 which is coated by an adhesive layer 14, which is, in turn, coated by a pile layer 16 that is comprised of a plurality of short lengths of pile fiber 18 that adhere to adhesive layer 14. As shown in FIG. 1*b*, for an unembossed pile fabric, the individual pile fibers 18 are typically oriented essentially parallel to each other and essentially perpendicular to the surface of the adhesive layer 14 in which they are embedded.

Substrate 12, as shown, is comprised of a woven fabric formed by warp yarns 21 and fill yarns 23. Substrate 12 can be formed from a variety of woven materials incorporating natural and/or synthetic fibers, or combinations thereof. In one particular embodiment, the substrate can comprise a poly-cotton blend of 65%/35% having a weight in the order of 3.0 to 3.5 oz/sq. yd. While in the illustrated embodiment, a woven fabric is shown as a substrate, it should be understood that in other embodiments, substrate 12 may be any type of material suitable for flocking with a pile layer, such as a variety of woven fabrics, nonwoven fabrics, knitted fabrics, porous or non-porous plastic and paper sheets, and the like, as apparent to those of ordinary skill in the art.

Adhesive layer 14 can be any conventional adhesive known in the art for use in fabricating flocked pile fabrics. Such adhesives include a wide variety of water based and/or solvent based adhesives. Also, as apparent to those of ordinary skill in the art, the adhesives may further include such components as viscosity modifiers, plasticizers, thermosetting resins, curing catalysts, stabilizers, and other additives well known in the art. The viscosity and composition of the adhesive chosen can be selected according to criteria readily apparent to those of ordinary skill in the art, including, but not limited to, the porosity and composition of substrate 12, the desired cure time and technique employed, the particular method of depositing pile fibers 18 onto the adhesive, the final weight and hand of the pile fabric desired, etc. In one particular embodiment, adhesive layer 14 comprises an acrylic polymer adhesive, which is applied on substrate 12 to have an essentially uniform thickness and a coating density of about 2.0 to 3.0 oz/sq. yd. of pile fabric. For a more detailed discussion of adhesives and various additives which can be used for forming adhesive layer 14, the reader is referred to U.S. Pat. No. 3,916,823 to Halloran, incorporated herein by reference.

Pile fibers 18 comprising pile layer 16 may similarly be comprised of a wide variety of natural and/or synthetic fibers according to the particular desired characteristics of pile fabric 10. In a preferred embodiment, pile layer 16 is comprised of pile fibers 18 formed from a synthetic polymer material. In even more preferred embodiments, pile fibers 18 comprise nylon fibers. Fibers 18 for flocking may be natural in color or dyed, depending on the particular application, and pile layer 16 may be formed of pile fibers 18 which are all of the same color, thus forming a pile face 16 having a solid color, or from a plurality of pile fibers 18 having different colors, thus forming a pile face 16 that is multicolored. For use in the present invention, where a printed pattern is transferred to the pile fabric, it is preferred to use pile fibers of the same color or undyed pile fibers.

The length of pile fibers 18, their denier, and the number density of the pile fibers on adhesive layer 14 can be varied over a relatively wide range and selected to yield a pile fabric having desirable characteristics for a particular application, as would be apparent to those of ordinary skill in the art. In one typical embodiment, pile fibers 18 can have an overall length between about 0.025 in and about 0.08 in (more preferably between about 0.04 in and about 0.065 in), a denier between about 0.45 and about 3.5, and an overall pile density of between about 1.0 to about 3.5 oz/sq. yd. of fabric. Pile layer 16 can be deposited on the adhesive coated substrate, as discussed in more detail below, by a variety of methods conventional in the art, including the use of flocked depositing equipment of the beater bar type, or electrostatic flocking equipment, such as described in more detailed in commonly-owned U.S. Pat. No. 5,108,777 to Laird incorporated herein by reference. A printed pattern may also be transferred to the flocked fabric by a variety of conventional techniques, including, but not limited to, screen printing, transfer paper printing, painting, air brush, etc., as apparent to those of ordinary skill in the art.

Figure 2A:
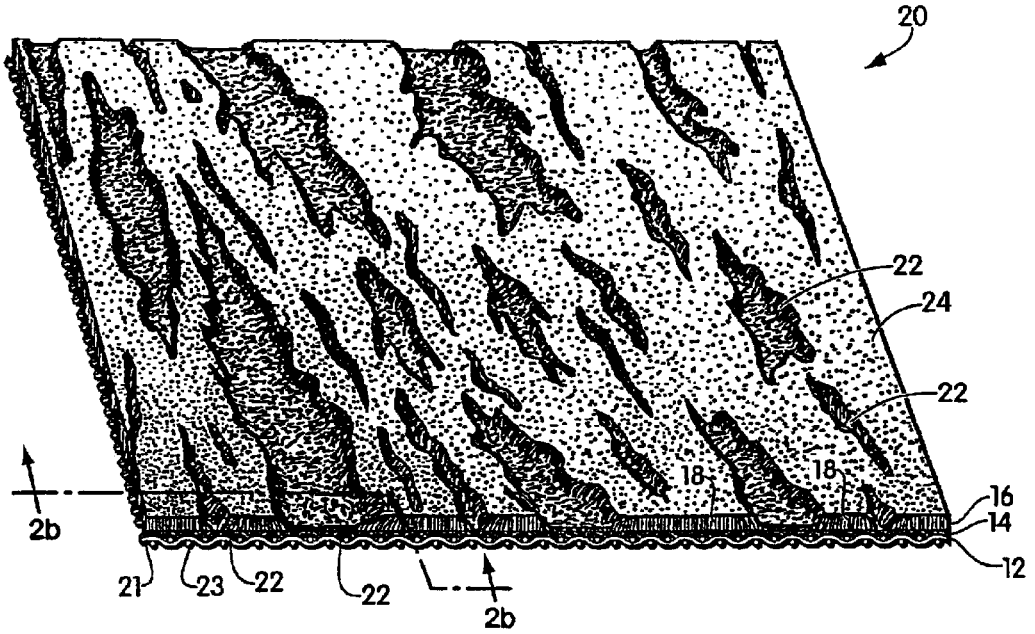
FIG. 2*a* is a schematic perspective view of an embossed pile fabric produced in accordance with the present invention.

FIG. 2 illustrates a flocked fabric 20 that is typical of the fabric that has been air embossed utilizing air embossing systems and methods provided according to the invention. Pile layer 16, comprising the embossable surface of fabric 20, includes therein a plurality of air embossed features 22. Air embossed features 22 are characterized by flattened or otherwise reoriented pile fibers. Adjacent to and separating embossed features 22 are unembossed portions 24 of the fabric surface, which are characterized by pile fibers 18 that extend essentially perpendicularly from adhesive layer 14.

Figure 2B:
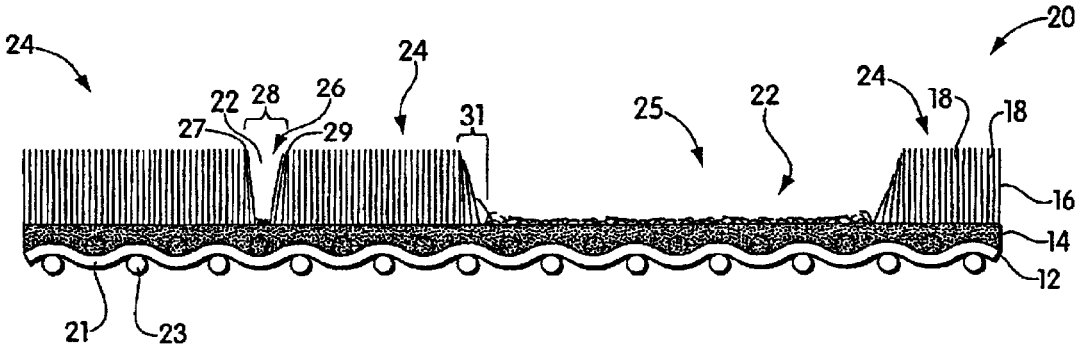
FIG. 2*b* is a cross-sectional schematic illustration of the embossed pile fabric of FIG. 2*a;*
Figure 2C:
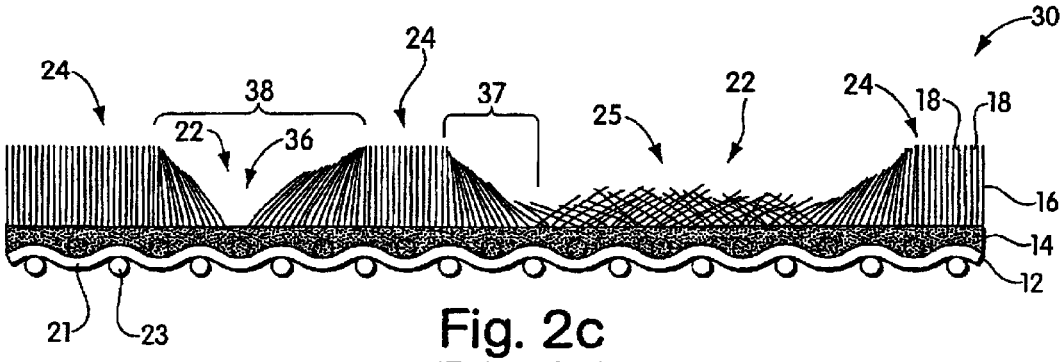
Fig. 2c (Prior Art)
FIG. 2*c* is a cross-sectional schematic illustration of an embossed pile fabric similar to that shown in FIG. 2*b*, except produced using prior art air embossing technology.

The orientation of pile fibers in the air embossed and unembossed portions of the fabric is seen more clearly in the cross-sectional view of FIG. 2*b*. FIG. 2*c* illustrates a similar embossed pile fabric 30 typical of that produced according to conventional prior art air embossing systems and methods. A comparison of the inventive air embossed fabric 20 and the conventionally air embossed fabric 30 illustrates several important distinctions. First, the inventive air embossed fabrics have embossed features wherein the smallest, most finely detailed embossed features have a characteristic dimension significantly less than that achievable with conventional systems and methods. For example, embossed fabric 20, provided according to the invention, includes a smallest embossed feature 26 having a small characteristic dimension 28. By contrast, the corresponding embossed feature 36 produced by a conventional system has a characteristic dimension 38 which is typically much greater. A "characteristic dimension" of an embossed feature, as used herein, refers to the smallest cross-sectional dimension of the feature, as measured from a first edge 27 of an unembossed portion of pile layer 16 across the feature to a second edge 29 of another unembossed region on the opposite side of the feature.

It can also be seen by comparing the larger embossed features of FIGS. 2*b* and 2*c* that fabric 20, provided according to the invention, has a significantly greater level of visual contrast between fibers in reoriented region 25 and the adjacent unembossed regions 24 of pile layer 16, when compared to fabric 30 produced according to conventional air embossing technology. Specifically, the reoriented fibers in reoriented portion 25 are significantly more flattened onto the substrate in the inventive fabric 20. In addition, distance 31 separating the flattened fibers of reoriented portion 25 and the essentially perpendicular fibers of an adjacent unembossed portion 24 can be very small and significantly less than the equivalent distance 37 of fabric 30 typically achievable using conventional air embossing technology. Thus, air embossed fabrics produced by air embossing systems and methods according to the invention can have an unprecedented level of fine detail and an unprecedented level of sharpness and visual contrast between embossed and unembossed portions of the pile fabric, yielding embossed patterns and visual effects previously unachievable by air embossing systems and producible only via utilization of more expensive roll embossing techniques.

Figure 3:
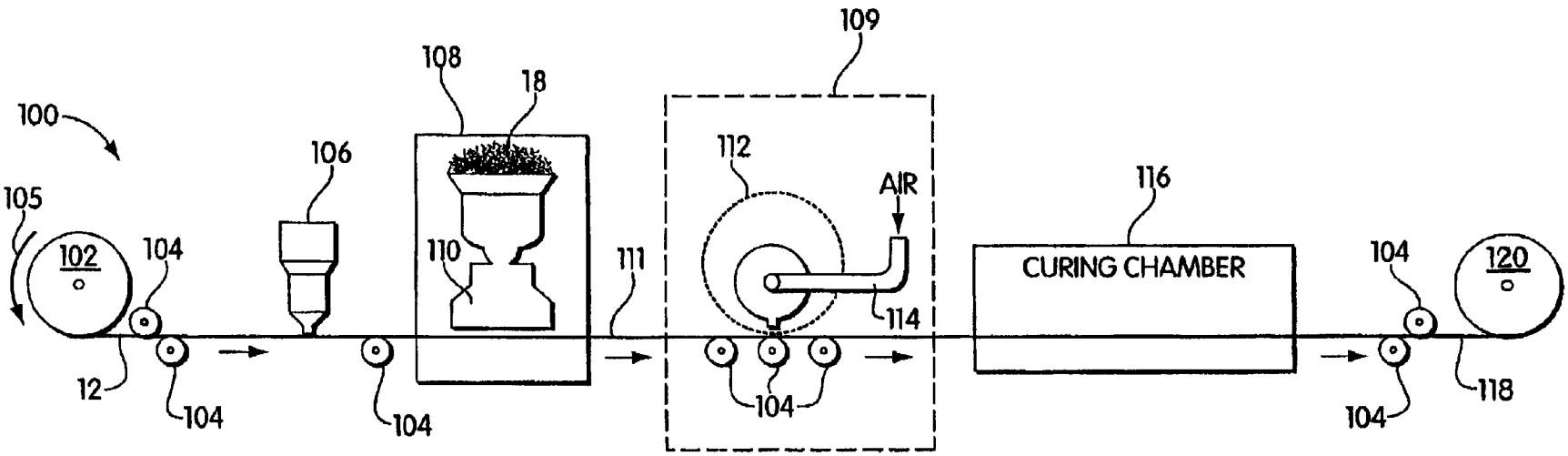
FIG. 3 is a schematic diagram of a process for embossing a pile fabric according to one embodiment of the invention.

FIG. 3 illustrates a preferred method according to the invention for forming and embossing a flocked pile fabric according to the invention. Embossed fabric production system 100 shown in FIG. 3, with the exception of the inventive modifications to air embossing system 109 described in detail below, can be essentially conventional in design and can be operated by methods well known to those of ordinary skill in the art. Such methods and systems for air embossing have been utilized extensively in the prior art and are described in more detail, for example, in U.S. Pat. No. 3,916,823 to Halloran. The process for producing an embossed pile fabric, for example similar to fabric 20 shown previously in FIG. 2*a*, can proceed as described below. Roll 102 of a substrate 12 can be conveyed, in the direction indicated by arrow 105, under tension from substrate roll 102 to take up roll 120 via conventional motor drive mechanisms for controllably driving one roll (i.e. take up roll 120) or both rolls. The fabric can be guided and supported along the path of the process via a series of support rollers 104. In other embodiments, instead of, or in addition to, conveying the fabric via motor-driven rotation of the take up roll/substrate roll, the fabric may be moved through the system via a conventional conveying system, such as a belt or apron conveyor. An adhesive layer is then applied to substrate 12 by a conventional adhesive applicator 106, for example a roll coater, curtain coater, doctor blade, printing method etc. Typically, the adhesive is applied to the substrate by a doctor blade, although other methods such as printing, paint spraying and silk-screening may be used. In a preferred embodiment, an adhesive layer is applied to the entire upper surface of substrate 12.

Substrate 12, now coated with an adhesive layer, is then passed to flocking chamber 108, which includes a pile applicator 110. In flocking chamber 108, as is conventional for producing flocked fabric, a layer of flocking formed by a multiplicity of fibers 18 is applied to the adhesive. Conventionally, and as hereinafter described, this deposition may be achieved by conventional beater bar or electrostatic techniques in which the ends of the pile fibers 18 adhere substantially to the adhesive layer. Pile fibers 18, in preferred embodiments, are oriented essentially perpendicular to the adhesive layer. In some preferred embodiments, flocking chamber 108 may comprise an alternating current electrostatic flocking device having a variable frequency alternating electrostatic field that optimizes flocked fiber characteristics and processing efficiency, such as that described in co-owned U.S. Pat. No. 5,108,777 to Laird and incorporated herein by reference.

After application of a pile layer, the flocked substrate 111 is passed under air embossing cylinder 112, which includes an air lance therein (shown and described in detail below) that is in fluid communication with pressurized air supply line 114. As described in more detail below, air embossing cylinder 112 typically comprises a cylindrical screen or stencil having perforations and solid areas therein. Also as described in more detail below, pressurized air from air supply line 114 is directed by the air lance through the apertures or perforations in the cylindrical screen or stencil of embossing cylinder 112, in order to form the embossed features within the pile layer of the fabric. An embossed pattern is formed by deflection of pile fibers 18 in the pile layer by air flowing through the apertures within the cylindrical screen or stencil of embossing cylinder 112. Upon flowing through the apertures in the stencil of embossing cylinder 112 the air impinges upon pile fibers 18 and orients them in a direction that is dictated in part by the air velocity, direction of air flow, and size of the aperture in the stencil through which the air passes. In other words, those portions of the pile layer passing underneath apertures within the cylindrical stencil will become oriented to form the depressions in the embossed pattern, whereas those portions passing under solid areas of the stencil will not be subject to substantial air flow or reorientation of pile fibers 18 in the pile layer. As will be apparent to those of ordinary skill in the art, it is preferred that the adhesive layer be in a wet, uncured state during the air embossing procedure, such that the pile fibers 18 are not rigidly held by the adhesive and are able to have their position and orientation changed by an impinging air flow. The velocity of the air flow impinging upon the pile layer should be sufficient to exert a force on pile fibers 18 in order to create a desired degree of reorientation of the fibers.

Figure 4A:
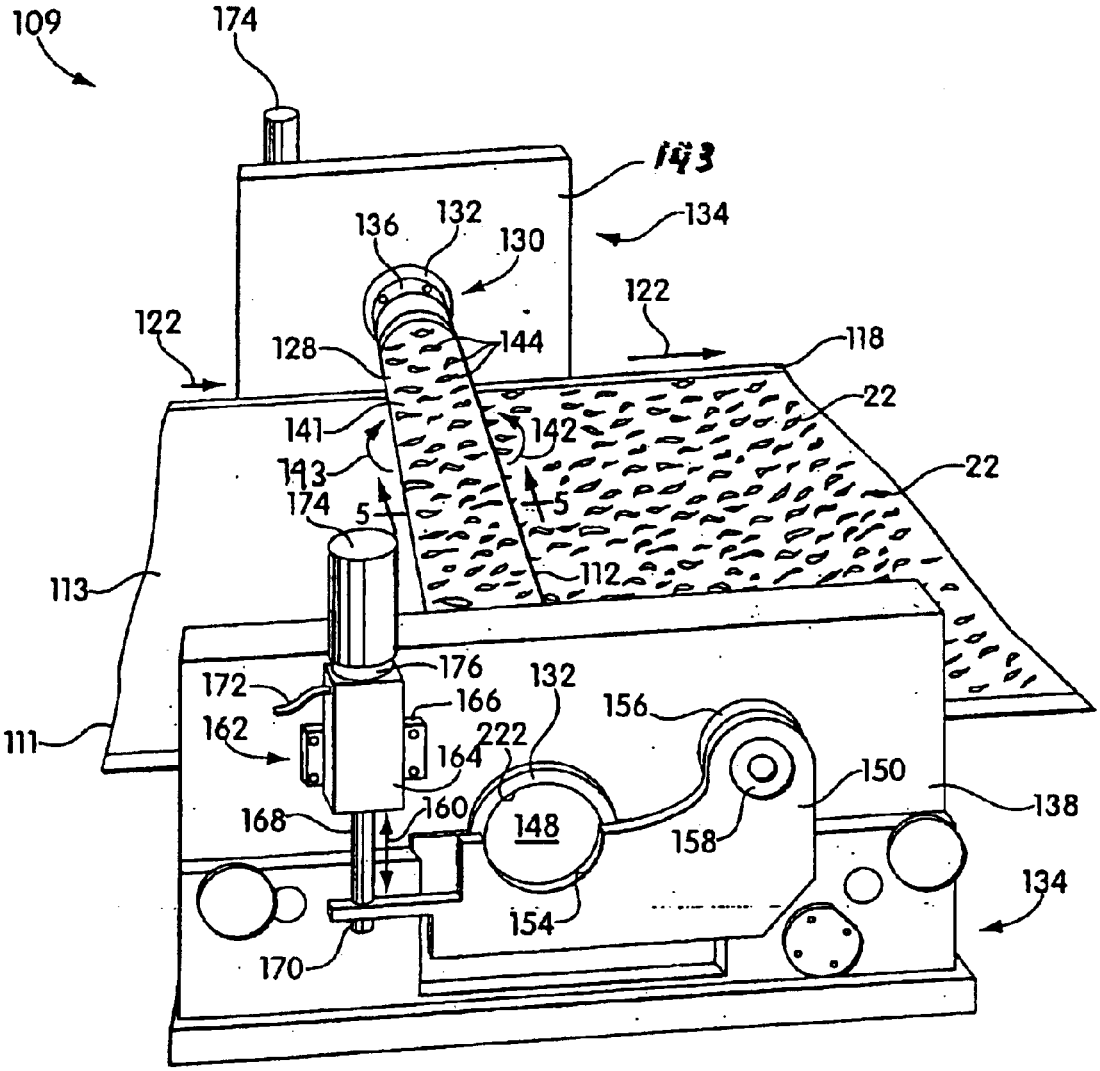
FIG. 4*a* is a schematic perspective view of an air embossing system for producing an embossed pattern on a pile fabric, as viewed from the right, according to one embodiment of the invention.
Figure 4B:
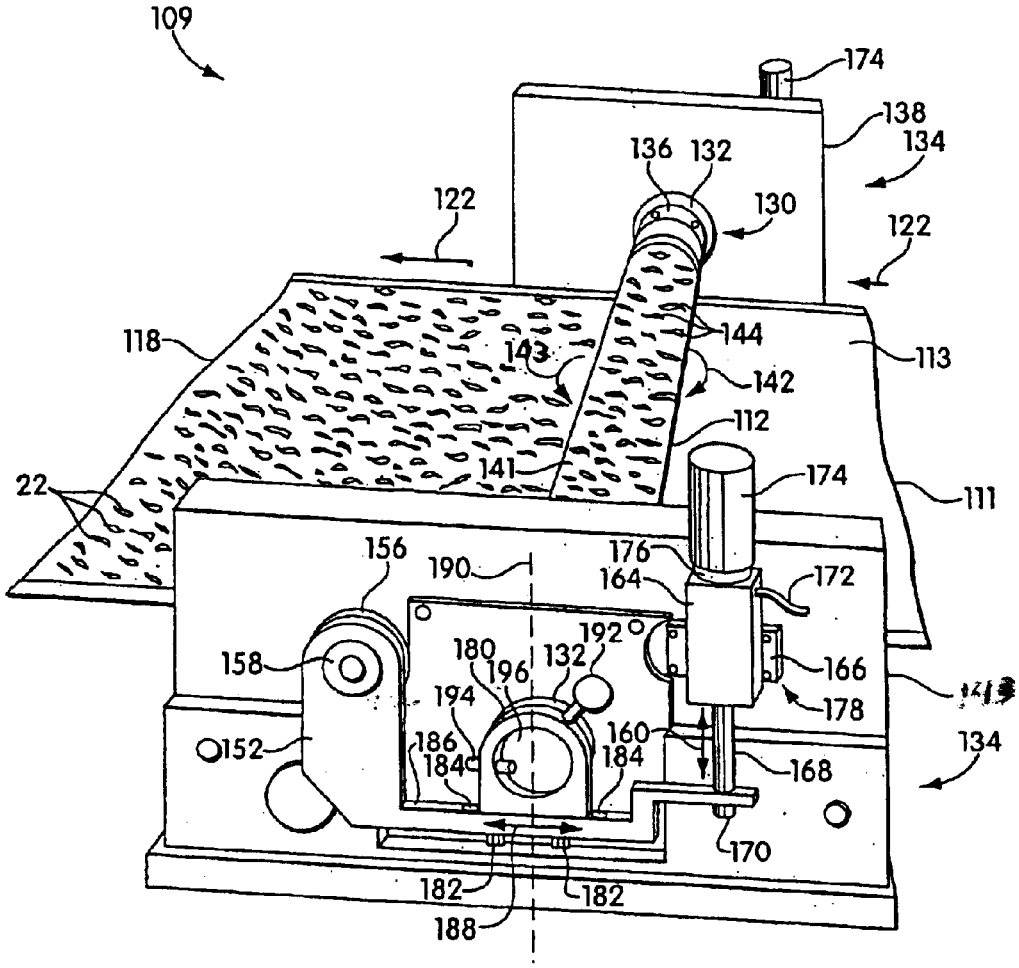
FIG. 4*b* is a schematic perspective view of an air embossing system for producing an embossed pattern on a pile fabric, as viewed from the left, according to one embodiment of the invention.
Figure 4C:
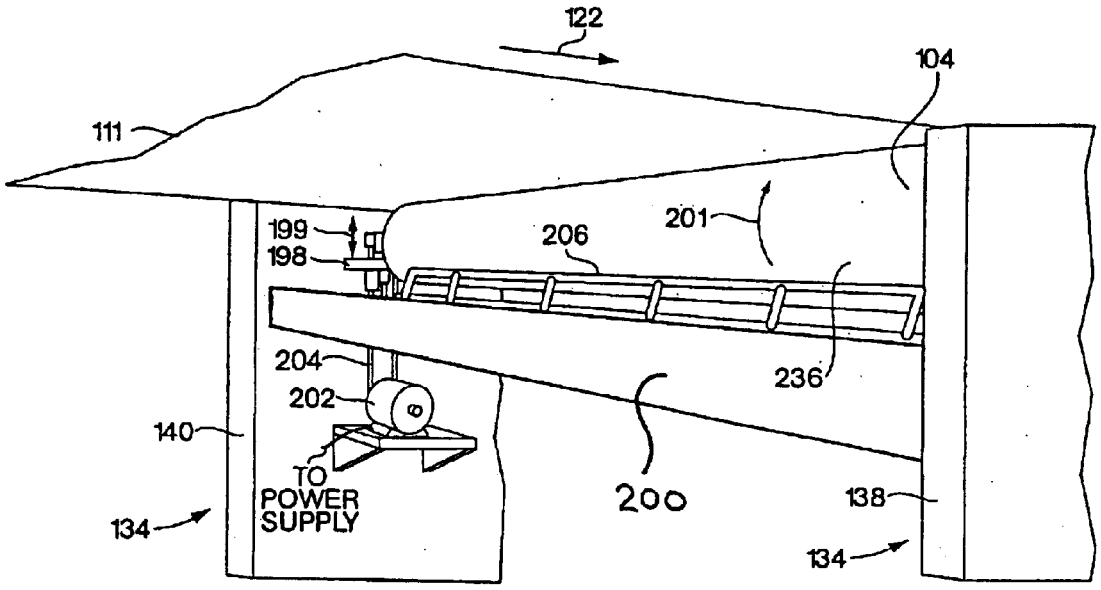
FIG. 4*c* is a schematic perspective view of an air embossing system for producing an embossed pattern on a pile fabric, as viewed from underneath the fabric, according to one embodiment of the invention.

After being embossed by embossing cylinder 112, the pile fabric is passed through a curing chamber 116 in order to cure the adhesive layer so that the embossed pattern becomes permanently set. Curing chamber 116 may be comprised of any conventional curing equipment that exposes the embossed, but uncured, pile fabric to radiation to effect curing of the adhesive layer. Typical curing chambers operate by exposing the flocked fabric to a source of radiation, such as infrared radiation or heat, or ultraviolet radiation. In some preferred embodiments, curing chamber 116 comprises a gas-fired air dryer, as is well known in the art, that exposes the flocked fabric to a flow of heated air to enable convective drying and curing of the adhesive. After being cured, the embossed flocked fabric 118 exits the curing chamber and is wound onto take-up roll 120. The speed at which the fabric is conveyed through air embossing system 100 can vary depending on a number of operating factors, as apparent to those of ordinary skill in the art. For some typical embodiments, the speed would be in the range of about, for example, 25 to 150 ft/min FIGS. 4*a*–4*c* show air embossing system 109 in greater detail. Air embossing system 109 comprises a modified version of a commercially available air embossing system (Aigle Equipment Model No. AP-1, Burgano Toninese, Italy). In alternative embodiments, the inventive features described herein may be utilized with other commercial available air embossing systems or may be integrated into a custom built and designed air embossing system, as would be apparent to those of ordinary skill in the art. Furthermore, it should be emphasized that any particular dimensions, sizes, materials, etc. described below for the illustrated embodiments of the invention are purely exemplary and are based upon the physical and operational constraints of the particular illustrated embodiment of air embossing system 109. Other embodiments of the invention, employing alternative air embossing systems, may utilize equipment having different sizes and dimensions and employing different materials than specifically described herein. Accordingly, the particular sizes, dimensions, materials etc. described below are given purely for illustrative purposes and may be scaled, modified, or changed for application of the inventive features to alternative air embossing systems, as would be apparent to those of ordinary skill in the art.

Referring to FIG. 4*a*, flocked, unembossed fabric 111, is conveyed, as previously described, toward embossing cylinder 112 in the direction shown by arrow 122. Embossing cylinder 112 includes a cylindrical central region, disposed above embossable surface 113 of unembossed fabric 111, comprising a cylindrical stencil 128, described in more detail below. Embossing cylinder 112 includes at each end thereof a reduced diameter stencil flange 130 (seen more clearly in FIG. 5) whereby it is attached to rotating bearings 132 of motorized drive unit 134. Stencil flanges 130 are attached to rotating bearings 132 utilizing stencil mounting clamps 136, which may be of any conventional design known to those of ordinary skill in the art. Motorized stencil drive unit 134 includes support structures 138 and 140 disposed on opposite sides of the width of fabric 111. At least one of support structures 138 and 140 includes therein a variable speed motor (not shown) which powers a conventional drive mechanism to rotate stencil 128 with respect to fabric 111. The drive mechanism for rotating the cylinder can be any suitable drive mechanism known in the art, including, but not limited to, belt-drive, gear-drive, friction and wheel-drive, inductive-drive, etc. mechanisms as apparent to those of ordinary skill in the arts. The drive mechanism of the illustrated embodiment comprises a gear-drive mechanism in which a variable speed motor (not shown) within support structure 140 rotates a gear (not shown) which, in turn, is engaged with a circumferential gear (not shown) comprising an outer surface of rotating bearing 132 within support structure 138.

In the illustrated embodiment, the variable speed embossing cylinder drive motor can be operated to rotate cylinder 112 in the direction of arrow 143 (i.e., in a direction opposite that of the motion 122 of fabric 111) or, more preferably, in the direction of arrow 142 (i.e., in the same direction as the direction 122 of fabric 111).

In conventional prior art systems, embossing cylinder 112 is rotated in the direction of arrow 142 such that the speed of the surface of stencil 128 is essentially the same as the speed of fabric 111 passing under stencil 128. In such conventional embodiments, the rotational speed of apertures 144, within stencil 128 of embossing cylinder 112, is matched to the speed of fabric 111 passing underneath, resulting in embossed features 22 in the air embossed fabric 118 having an overall length, as measured in the direction of motion 122 which is essentially the same as the overall length of the aperture 144 in stencil 128, as measured along the direction of rotation 142, which forms the embossed feature. By utilizing the variable speed motor drive provided according to the invention, stencil 128 can be rotated, in some embodiments, at speeds that are different than the speed of the fabric passing under the stencil, in order to create a variety of embossed patterns on the fabric, which each have a different visual appearance, with a single, given stencil.

For example, by rotating the stencil in direction 142 at a speed which is greater than that of the speed of the fabric passing under the stencil, the embossed features produced by: air passing through apertures 144 are shortened as measured along a direction parallel to the direction of motion 122 of the fabric when compared to an equivalent embossed pattern produced by a stencil rotating at the same speed as the fabric. In contrast, by rotating stencil 128 in a direction of arrow 142 at a speed which is less than the speed of the fabric passing under the stencil, embossed features 122 can be relatively lengthened and the level of detail visually evident in the embossed feature can be increased when compared to features produced with a stencil rotated at the same speed as the speed of the fabric. Thus, by changing the relative speed of the stencil with respect to the fabric, a variety of different patterns can be produced utilizing a single stencil. In some embodiments provided according to the invention, the speed of the fabric differs from the speed of the rotating stencil by at least a factor of about 2, and in other embodiments differs from the speed of the fabric by at least a factor of about 4.

Figure 4D:
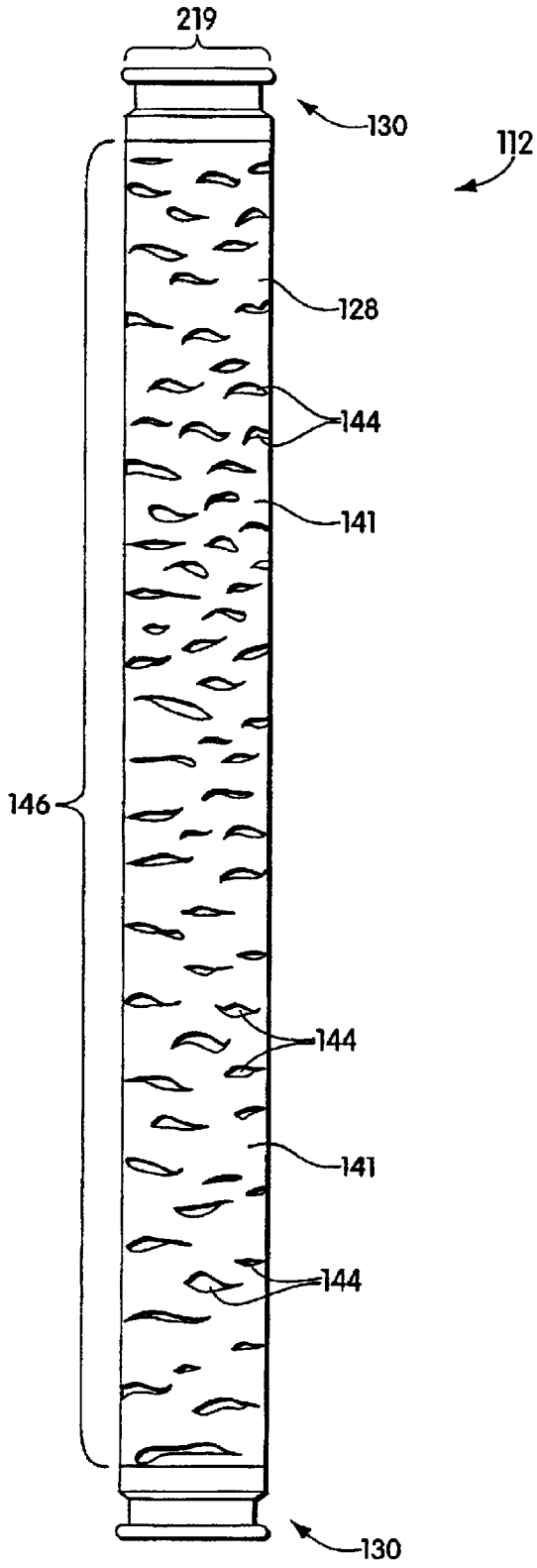
FIG. 4*d* is a schematic illustration of an embossing cylinder for producing an embossed pattern on a pile fabric according to one embodiment of the invention.

One embodiment for embossing cylinder 112 is shown in greater detail in FIG. 4*d*. Embossing cylinder 112 comprises a hollow cylinder having a centrally disposed stencil 128 defining an embossing region 146, which extends across the width of the fabric to be embossed. In the illustrated embodiment, the embossing region is between about 54 inches and about 64 inches in length The embossing cylinder 112, as illustrated, has a stencil region 128 having an outer circumference of about 25 inches. The inner diameter of stencil region 128, in the illustrated embodiment, is about 7.95 inches, while the inner diameter of stencil flange 130 is about 5.5 inches.

Cylindrical stencil 128 can be conventionally formed from, for example, a cylindrical screen which has a series of solid, air impermeable regions 141 therein and a series of apertures 144 therein, which apertures permit air flow therethrough. Cylindrical stencil 128 can be formed in any manner conventionally used for forming such stencils. For example, in one embodiment, cylindrical stencil 128 can be formed using a well known lacquered screen process, where a cylindrical screen, typically constructed from a metal such as nickel, is coated with a lacquer. In forming the stencil, for such embodiments, the screen is first coated with an essentially uniform layer of lacquer, covered with a pattern template having regions that can block ultraviolet radiation, and exposed to ultraviolet radiation which tends to cure the lacquer. The regions of the screen beneath the pattern template regions that can block ultraviolet radiation will remain uncured after exposure and can be subsequently removed from the screen, thus leaving behind on the screen a lacquer coating, forming the stencil, having apertures therein with a pattern that is complementary to that of the pattern template. In another embodiment, the stencil can be formed by coating a metal screen with a patterned metallic layer using a Galvano process well known in the art. In yet other embodiments, cylindrical stencil 128 can be formed by directly covering a cylindrical screen with an air impermeable layer, such as a paper, plastic, or other air impervious layer, and then cutting out selected portions from the air impervious layer to form apertures 144. It is to be understood, of course, that regions corresponding to apertures 144 may be cut out of the air impervious layer prior to utilizing the layer to form cylindrical stencil 128. In other embodiments, cylindrical stencil 128 may be formed from a stencil typically employed for use in rotary screen printing operations or by any other methods apparent to those of ordinary skill in the art for forming air embossing stencils. Apertures 144 in cylindrical stencil 128 result in the formation of embossed depressions 22 in embossed fabric 118 as air passes through the apertures and impinges upon fabric 111 as it passes under embossing cylinder 112. As is apparent in FIG. 2*a*, the embossed depressions 22 formed by apertures 144 can typically have a similar overall shape and orientation as the apertures in cylindrical stencil 128.

Referring again to FIG. 4*a*, support structures 138 and 140 also include mechanisms thereon for holding and positioning an air lance (shown and described in detail below), which air lance is configured and positioned to direct a stream of air through apertures 144 in stencil 128 and onto fabric 111 to produce embossed features 22 in embossed fabric 118. In FIGS. 4*a* and 4*b*, in order to more clearly illustrate the air lance support and positioning mechanism, the air lance has been removed from the system and is not illustrated. When assembled for operation, the elongated air lance is inserted into aperture 148 in rotating bearing 132 such that it is disposed within embossing cylinder 112, extends across the width of embossing cylinder 112, and is supported by air lance inlet cradle 150 and air lance outlet cradle 152 (shown more clearly in FIG. 4*b*) of system 109. Aperture 148, from which the inlet region of the air lance extends when installed in its operable configuration, has an internal diameter which is essentially equal to the internal diameter of stencil flange region 130 (i.e., about 5.5 inches as illustrated) of embossing cylinder 112.

When configured for operation, the inlet region of the air lance is cradled and supported by air lance inlet cradle region 154 of air lance inlet support arm 150. Preferably, air lance inlet cradle region 154 is sized and shaped such that it is complementary to the size and shape of the inlet region of the air lance so that the inlet region of the air lance rests snuggly and securely within the air lance cradle region, when the system is in operation.

Air lance inlet support arm 150 is pivotally attached to support structure 138 via spacer 156 and pivot bearing 158 so that the support arm can be pivoted up and down in the direction of arrows 160 in order to adjust the height of the air lance with respect to embossing cylinder 112 and in order to adjust the distance between the nozzle(s) in the air lance and the inside surface of stencil 128, as described in more detail below.

Height adjustment of the air lance, supported by air lance inlet support arm 150, is effected by air lance inlet height adjuster 162. Height adjuster 162 comprises a main body 164 attached to the face of support structure 138 via mounting bracket 166. Height adjuster 162 further includes a reciprocating piston 168 connected to the air lance inlet support arm 150 via a nut 170 on a threaded end thereof. In preferred embodiments, air lance inlet height adjuster 162 has a range of motion such that in a lower most position a nozzle of an air lance inserted into embossing cylinder 112 can contact the lowermost internal surface of the embossing cylinder, and an uppermost position providing a separation distance between the nozzle of the air lance and an internal surface of embossing cylinder 112 that is at least as great as the maximum separation distance desired during operation the system. In the illustrated embodiment, air lance inlet height adjuster 162 is pneumatically actuated via air line 172 to effect coarse up and down adjustment, and also includes a manually actuated fine height adjustment knob 174, which is utilized by an operator to make fine height adjustments. The height adjuster also, if desired, can include a scale 176, which can assist an operator to accurately and reproducibly position the inlet of the air lance.

Details of the mechanism provided on support structure 140 for positioning and supporting a mounting shaft of an air lance, which mounting shaft being positioned at the opposite end from the inlet of the air lance (shown more clearly in FIGS. 6–8), is illustrated in FIG. 4*b*. Air lance mounting shaft support arm 152 is similar in configuration to air lance inlet support arm 150 and is pivotally movable in order to adjust the height and position of the downstream end of the air lance via air lance downstream end height adjuster 178 which is essentially identical in design to inlet height adjuster 162. Height adjuster 162 and height adjuster 178, in preferred embodiments, are adjusted to create an essentially uniform distance between the nozzle(s) of the air lance and an adjacent internal surface of embossing cylinder 112 that is essentially uniform across essentially the entire width of stencil region 128 of embossing cylinder 112. In other embodiments, however, the height adjusters may be differentially adjusted such that some nozzles of the air lance are closer to the stencil than others, or some portions of a given nozzle provided by the air lance are closer to the internal surface of the stencil than other portions.

As illustrated below in FIGS. 6–8, which show a variety of air lances provided according to the invention, the downstream ends of the illustrated air lances include mounting shafts having outer diameters which are typically less than the outer diameters of the main body portions and inlet regions of the air lances. The mounting shaft of the air lance is supported and positioned by air lance mounting shaft support clamp 180 which is mounted to support arm 152 via bolt and nut fasteners 182. In the illustrated embodiment, mounting shaft support clamp 180 is mounted within a slot 184 on a platform region 186 of support arm 152. This configuration allows mounting shaft support clamp 180 to be slidably movable in the direction of arrows 188, in order to adjust the lateral position of the downstream end of the air lance within embossing cylinder 112. In preferred embodiments, the lateral position of the mounting shaft support clamp is adjusted so that the nozzle(s) of the air lance is positioned such that it is bisected by center line 190 of embossing cylinder 112.

Mounting shaft support clamp 180 also includes an angular adjustment set screw and knob 192 which can be utilized to adjust the angular orientation of the air lance within embossing cylinder 112. Support clamp 180 also includes perpendicular alignment set screw 194, which is mateable with an alignment hole (see FIGS. 6–8) within the mounting shaft of the air lance. When alignment set screw 194 is inserted into the alignment hole, it serves to fix the angular adjustment of the air lance so that the nozzle(s) is positioned to direct a stream of air essentially perpendicularly to the lowermost region of the internal surface of stencil 128 of embossing cylinder 112 (shown more clearly in FIG. 5 below). In certain embodiments, set screw 194 may be turned out so that it does not project into aperture 196 of mounting shaft support clamp 180, and the air lance may be positioned and secured utilizing angular adjustment set screw in knob 192 so as to position and secure the mounting shaft within aperture 196 at an orientation such that the nozzle(s) is not perpendicular and/or is not configured to direct an air stream essentially perpendicular to the lowermost internal surface of stencil 128 of embossing cylinder 112. In certain such embodiments, the air lance may be positioned such that the air stream forms an angle of, for example, about 5 degrees to about 10 degrees with respect to center line 190.

FIG. 4*c* illustrates a view of air embossing system 109 as seen by an observer positioned underneath fabric 111. In preferred embodiments, system 109 includes a support surface 236 positioned directly beneath stencil 128 that is configured to support the underside of fabric 111 at a location where the adjacent embossable surface of the fabric is being impinged upon by an air stream emitted by the nozzle(s) of the air lance, when installed in the system during operation While in alternative embodiments to that illustrate in FIG. 4*c*, the support surface may comprise a platform or other planar surface, it is preferred, as illustrated, that the support surface comprise a cylindrical, fabric support roller 104.

In the illustrated embodiment, fabric support roller 104 is mounted on roller mounting arms 198, which are supported by a roller support beam 200. In some embodiments, roller mounting arms 198 may be configured so that the vertical position of fabric support roller 104 may be adjusted with respect to roller support beam 200, fabric 111 and stencil 128 in the direction of arrows 199. Fabric support roller 104, in preferred embodiments, is configured to be rotated, most preferably in a direction of motion 201 co-directional to fabric 111.

In the illustrated embodiment, fabric support roller 104 is driveably rotated via electric motor 202 and drive belt 204 located on motor support platform 203. In alternative embodiments, as would be apparent to those of ordinary skill in the art, fabric support roller 104 may be rotated by a wide variety of alternative mechanical means. In the preferred embodiment illustrated, a surface cleaning element 206 is provided in contact with an external surface 236 of fabric support roller 104. Surface cleaning element 206 serves to scrape off and remove any adhesive, pile fibers, or other debris which may collect on the surface 236 of fabric support roller 104, thus eliminating or reducing any buildup of debris under the surface of fabric 111 during operation, which buildup in prior art systems typically limits the length of time the system can be operated without shutdown and cleaning of the support surface. In the illustrated embodiment, surface cleaning element 206 comprises a scraping blade positioned in contact with the outer cylindrical surface 236 of fabric support roller 104 along essentially the entire width of the fabric support roller positioned directly beneath stencil region 128 of embossing cylinder 112. In the most preferred embodiments, the surface cleaning element is positioned to contact the support roller along substantially the entire length of the roller that is in contact with the underside of fabric 111. Those of ordinary skill in the art will readily envision many other surface cleaning elements which may be utilized instead of scraping plate 206, for example, brushes, air jets, water jets, etc., which are all deemed to be within the scope of the present invention.

Figure 5:
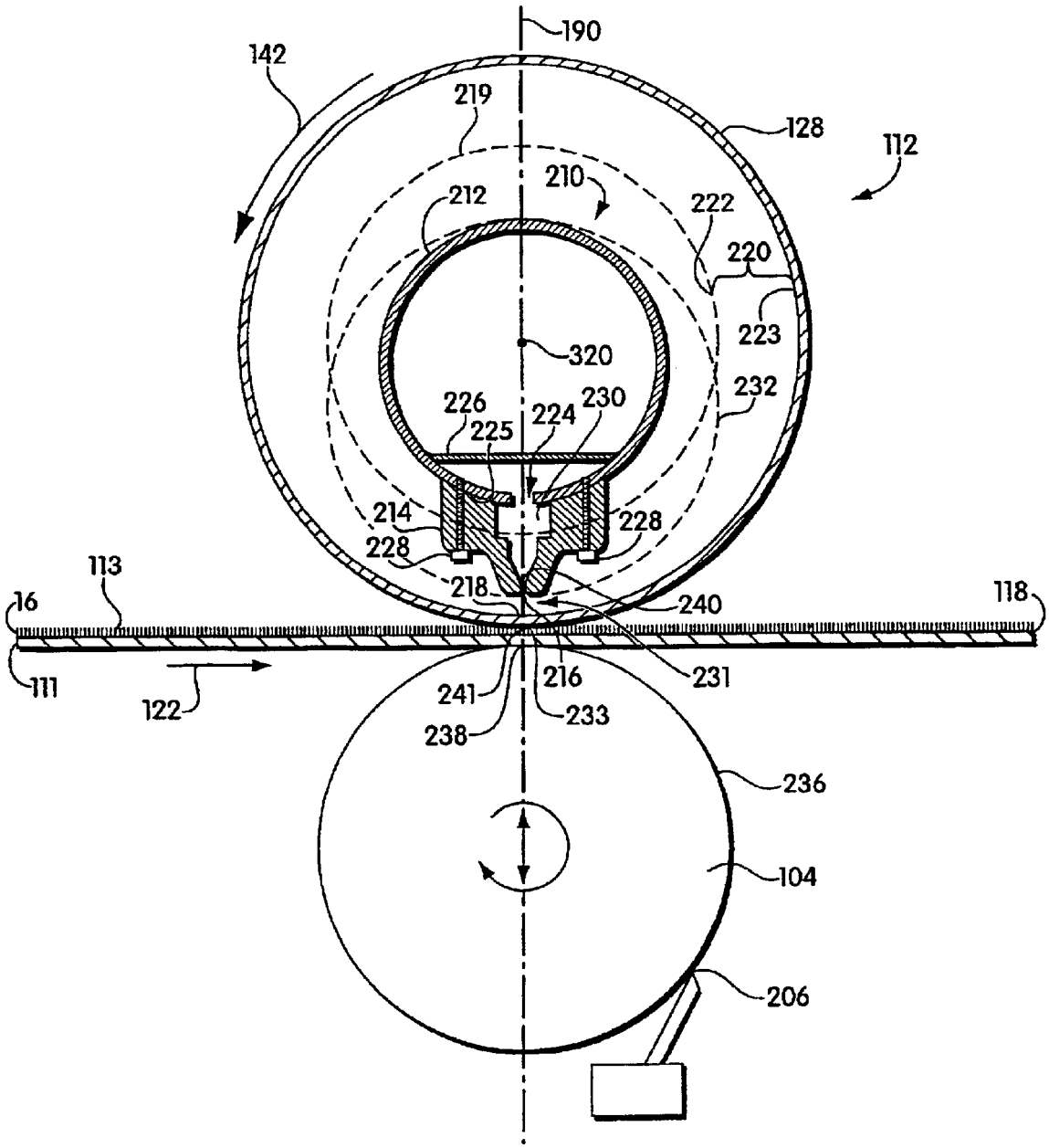
FIG. 5 is a cross-sectional schematic illustration of certain components of the air embossing system of FIGS. 4*a*–4*c*, including an air lance mounted therein.

FIG. 5 is a cross-sectional view of air embossing system 109. For the purposes of illustration of the relative position of certain of the different elements of system 109, FIG. 5 illustrates a cross-sectional view of air embossing system 109 with one embodiment of an air lance provided by the invention installed within the system and with certain details of the surrounding support structures not illustrated for clarity.

Air lance 210 is similar in design to air lance 700 illustrated and discussed in greater detail in the context of FIGS. 8*a*–8*f* below. As discussed above, air lance 210, when installed in operable engagement with air embossing system 109, has an inlet region supported and positioned by air lance inlet support arm 150 and air lance inlet height adjuster 162, and has a mounting shaft at its downstream end that is supported and positioned by air lance mounting shaft support arm 152 and air lance mounting shaft height adjuster 178.

Air lance 210 illustrates one embodiment for an air lance which enables the nozzle(s) of the air lance to be positioned in close proximity to an internal surface of the stencil. Air lance 210 is shaped in the form of a tubular conduit and includes a main body portion 212 to which is attached a nozzle forming component 214. Nozzle forming component 214 includes at its end a nozzle 216 and is shaped and positioned to enable the nozzle to be placed in very close proximity to surface 218 of the internal surface of stencil 128, which surface 218 faces and is adjacent to the nozzle and is directly adjacent to fabric 111.

As discussed in more detail below, in order to minimize pressure drop along the length of the air lance and in order to provide a desirable distribution of air flow within the air lance, main body portion 212 preferably is essentially uniform in diameter along the entire length of the air lance through which air flows, when the air lance is in operation. Accordingly, because of the physical constraints imposed by the air embossing system, conventional prior art air lances having nozzles formed directly in the side wall of the main body portion of the air lance and not including a nozzle forming component, such as nozzle forming component 214, which projects and extends away from the side wall of the main body portion, cannot be positioned within the embossing cylinder so that the nozzle is in close proximity to the inner surface of the stencil.

The physical constraint of the air embossing system which prevents a nozzle formed directly in the side wall of a conventional air lance from being positioned in close proximity to the inside of the stencil is due to the difference in internal diameter of stencil 128 and the smallest internal diameter 219 of stencil flange 130 and aperture 148 of the air embossing system. As discussed previously, for a typical setup utilizing a stencil having a 25 inch outer circumference with a 7.95 inch internal diameter and having a flange having an internal diameter of about 5½ inches, a distance 220 of about 1.2 inches exists between the inner surface 222 of aperture 148 and stencil flange 130 and the inner surface 223 of stencil 128. For conventional air lances without a nozzle forming component and having an inlet region having a diameter equal to or similar to the diameter of the main body portion, a nozzle formed in the side wall of the main body portion will be constrained by contact of the inlet portion of the air lance with surface 222, which contact will prevent the nozzle from being able to be positioned from the internal surface 218 of stencil 128 by a distance that is significantly less than distance 220.

Nozzle forming component 214, which extends along a substantial fraction of the length of main body portion 212 but does not extend into the inlet portion of the main body, is able to bridge distance 220 to enable the nozzle 216 to be positioned as close to surface 218 of stencil 128 as desired. Nozzle forming component 214, as described in more detail below in the context of FIGS. 8*a*–8*f*, preferably extends along the length of main body portion 212 across essentially the entire width of stencil 128 and fabric 111, but does not extend into regions of the main body portion adjacent to internal surface 222.

It is generally desirable to maximize the internal diameter of main body portion 212 in order to minimize any pressure drop along the length of air lance 210, when the system is in operation. It is also required to size nozzle forming component 214 so that it extends from the external surface of main body portion 212 by a distance that enables nozzle 216 in the nozzle forming component to be positioned at a desirable distance from surface 218 of stencil 128. Thus, nozzle forming component 214 is shaped and positioned to enable nozzle 216 to be separated from surface 218 by a distance that is substantially less than the distance separating outlet opening 224 in main body portion 212, which outlet opening is in fluid communication with nozzle 216, and surface 218. "Substantially less than" when referring to the above discussed distance between nozzle 216 and surface 218 in comparison to the distance separating outlet opening 224 and surface 218 indicates that the distance separating nozzle 216 and surface 218 is no more than about 60% of the distance separating outlet opening 224 and surface 218, and may, in some preferred embodiments, be less than 1% of the distance separating the outlet opening in the main body of the air lance and surface 218 of the stencil.

In the illustrated embodiment, main body portion 212 of air lance 210 comprises an aluminum conduit having a wall thickness of about ⅛ inch and an outer diameter of about 4 inches. In other embodiments, air lance 210 may be constructed of a variety of other materials, for example, other metals, plastics, etc. and may have a wall thickness different than that above, which is selected to provide sufficient resistance to operating pressure for the chosen material, as would be apparent to those of ordinary skill in the art. As discussed above, the main body portion 212 includes an outlet opening 224 therein, which is in fluid communication with nozzle forming component 214. Outlet opening 224 may comprise a plurality of holes in the side wall of main body portion 212; however, in more preferred embodiments such as that illustrated, outlet opening 224 comprises an elongated slot extending along a substantial portion of the length of the main body portion, as illustrated more clearly in FIGS. 8*a*–8*f* Main body portion 212 may also be stabilized against internal pressure by including one or more internal support struts 226 along its length, which can be welded or otherwise attached to main body portion 212 and can extend across outlet slot 224 in order to resist expansion of main body portion 212 when the air lance is in operation.

Typically, when in operation, the inlet of air lance 210 is attached to an air supply 114, as shown above in FIG. 3, which preferably comprises a variable speed blower able to provide a user-adjusted volumetric flow rate of air to air lance 210. Typical operating pressures within air lance 210 can range from about 1 inch $H_2O$ to about 100 inches $H_2O$.

Nozzle forming component 214 may be formed of any suitable material, as would be apparent to those of ordinary skill in the art, and, in preferred embodiments is formed of a rigid metal. Nozzle forming component 214 spans outlet slot 224 of main body portion 212 and includes an upper curved surface 225 shaped to conform to the contour of the outer surface of main body portion 212. Nozzle forming component 214 may be attached to main body portion 212 by any variety of means apparent to those of ordinary skill in the art. In the illustrated embodiment, nozzle forming component 214 is removably attached to main body portion 212 via a plurality of bolts 228 positioned along the length of the nozzle forming component on opposite sides of outlet slot 224.

Nozzle forming component 214, as illustrated, includes an internal chamber 230 therein which extends along the length of the nozzle forming component coextensive with nozzle 216. Nozzle 216 can comprise a plurality of individual holes or ports within the lower surface of nozzle forming component 214; however, in order to avoid artifacts caused by the air impermeable spaces between nozzles comprising individual apertures or orifices, in preferred embodiments, nozzle 216 comprises an elongated rectangular slit extending along a substantial fraction of the length of nozzle forming component 214 and across the width of stencil 128 and the embossable width of fabric 111, when installed in the system.

In preferred embodiments, nozzle slit 216 extends along the length of nozzle forming component 214 so that it is co-extensive with outlet slot 224 in main body portion 212 and is aligned directly beneath and parallel with the outlet slot. In the illustrated embodiment, nozzle forming component 214 extends away from main body portion 212 so that nozzle 216 is separated from outlet opening 224 by a distance of about 1.25 inches, which is sufficient to span the entirety of distance 220 separating surface 218 and surface 222, when the air lance is positioned in an operable configuration within the air embossing system. The illustrated combination, for example, of a 4 inch external diameter main body portion 212 and a nozzle forming component 214 that extends away from the main body portion by a distance by about 1.25 inches, results in an overall effective diameter 232 of air lance 210 that is just sufficient to clear smallest diameter 219 of stencil flange 130 and aperture 148 of the air embossing system.

It has been determined, according the invention, that by positioning nozzle 216 very close to surface 218 of stencil 128, which is directly adjacent to fabric 111, that the degree of collimation of air stream 231, emitted from the nozzle, at the point where the stream passes through stencil 128, is significantly enhanced over that of air streams emitted by conventional air lances at their point of passage through the embossing stencil. By reducing the distance separating nozzle 216 and surface 218, the length of air stream 231 between its source at nozzle 216 and surface 218 is accordingly reduced, and the amount of dispersion of the air stream is significantly reduced or eliminated, resulting in the ability to achieve much finer levels of detail and an improved appearance of the embossed features of embossed fabric 118. As described in much more detail below, the close proximity of nozzle 216 to surface 218 of stencil 128 combined with the ability of nozzle forming component 214 to effectively redirect airflow from a direction essentially parallel to longitudinal axis 320 of air lance 210 to a direction substantially perpendicular to the longitudinal axis enables air stream 231 to be directed in a direction that is much more perpendicular to the surface of fabric 111 than is achievable in conventional air lance designs.

As described previously in the context of FIGS. 4*a* and 4*b*, the position of air lance 210 and the distance separating nozzle 216 from surface 218 of stencil 128 can be adjusted by an operator as desired via manipulation of height adjusters 162 and 178. In addition, as previously described, the angular orientation of nozzle 216 with respect to center line 190 may be adjusted via angular adjustment set screw and knob 192 and perpendicular alignment set screw 194 (see in FIG. 4*b*). As illustrated in FIG. 5, air lance 210 is positioned such that its alignment slot in its mounting shaft (see e.g. FIGS. 8*a*–8*f*) is engaged by alignment set screw 194 so that nozzle 216 is positioned along the center line 190 of stencil 128 so as to direct air stream 231 essentially perpendicular to surface 218 and the embossable surface 113 of fabric 111. In preferred embodiments, nozzle 216 is positioned such that it is separated from surface 218 of stencil 128 during operation by a distance not exceeding about 0.75 inch, resulting in air stream 231 having a length between the nozzle 216 and surface 218 not exceeding about 0.75 inch. In other preferred embodiments, the distance separating nozzle 216 and surface 218 does not exceed about 0.5 inch, in other embodiments does not exceed about 0.25 inch, in yet other embodiments does not exceed about 0.1 inch, in other embodiments does not exceed about 0.05 inch, in yet other embodiments does not exceed about 0.025 inch, in other embodiments does not exceed about 0.0125 inch, and in yet other embodiments does not exceed about 0.01 inch.

In addition, it is preferred to adjust the vertical position of fabric support roller 104 and fabric 111 such that the upper most surface 113 of pile layer 16 is separated from external surface 233 of stencil 128, which surface 233 is directly adjacent internal surface 218 and is positioned directly above pile layer 16, by a distance not exceeding about 0.02 inch. In other embodiments, fabric facing surface 233 of stencil 128 is positioned from the embossable-surface of pile layer 16 by a distance not exceeding about 0.01 inch, in other embodiments by a distance not exceeding 0.005 inch, and yet in other embodiments by a distance not exceeding about 0.001 inch. Thus, it is desirable that the distance between surface 233 and pile layer 16 be very small but without surface 233 actually making physical contact with pile layer 16, which would tend to distort the pile air and create undesirable visual artifacts.

Also, as illustrated in FIG. 5, it is preferred that support surface 236 of fabric support roller 104 be positioned such that its upper most surface 238 is aligned with center line 190 such that surface 238 is positioned directed beneath and space apart from nozzle 216 such that air stream 231 exiting the nozzle is directed to impinge upon fabric 111 at a location 241 where the fabric is adjacent to and in contact with support surface 236. This configuration prevents the fabric from being pushed away from the embossing surface of stencil 128 by air stream 231 and maintains the desired distance between stencil 128 and pile layer 16 of embossable fabric 111.

Another way to improve the degree of collimation of air stream 232 and the ability of air lance 210 to produce fine embossed detail and desirable embossing performance is to substantially reduce the characteristic orifice dimension of nozzle 216 in comparison to characteristic orifice dimensions of nozzles in conventional air lances. A "characteristic orifice dimension" of a nozzle, as used herein, refers to the smallest cross-sectional dimension of the nozzle. In the illustrated embodiment, where nozzle 216 comprises an elongated rectangular slit, the characteristic orifice dimension 240 comprises the width of the elongated slit forming nozzle 216. For embodiments wherein the nozzles comprise circular holes, the characteristic dimension of each nozzle would be the diameter of the circular hole forming the nozzle. Similarly, for other shapes, the characteristic dimension can be determined by measuring the smallest cross-sectional dimension of the particular shape comprising the nozzle (e.g., for a nozzle comprising an ellipse, the characteristic orifice dimension would comprise the length of the minor axis of the ellipse). In preferred embodiments, the characteristic orifice dimension of the nozzles of air lances provided according to the invention is less than about 0.2 inch. In other preferred embodiments, the characteristic orifice dimension of the nozzle does not exceed about 0.1 inch, in other embodiments does not exceed about 0.05 inch, in yet other embodiments does not exceed about 0.01 inch, in other embodiments does not exceed about 0.005 inch, and in yet other embodiments does not exceed about 0.001 inch.

In addition to increasing the degree of collimation of air stream 232, by reducing the characteristic dimension of the nozzles of the air lances provided by the invention, the total amount of open area of the nozzles, through which the air stream passes, is a much smaller fraction of the cross-sectional internal area of the main body portion of the air lance supplying air to the nozzle. Thus, the inventive air lances, having nozzles with small characteristic orifice dimensions, generally have a much higher fraction of the total resistance to air flow provided by the nozzle(s) than is typical for conventional prior art air lance designs. In preferred embodiments, the total open area provided by the nozzle(s) of the air lances provided by the invention does not exceed about 15% of the internal cross-sectional area of the main body portion of the air lance. In other preferred embodiments the nozzle area does not exceed about 7.5%, in other embodiments does not exceed about 1.5%, and in yet other embodiments does not exceed about 0.1% of the total open cross-sectional area of the main body portion of the air lance.

By designing the inventive air lances so that most of the resistance to air flow is provided by the nozzle(s), the pressure drop along the length of the air lance can be substantially reduced, and the air flow emitted from the nozzle(s) along the length of the air lance can be much more evenly distributed than in conventional air lance designs. In some preferred embodiments, by employing a nozzle(s) with a very small characteristic orifice dimension, the air flow velocity through the nozzle(s) of the air lance can be substantially constant along the portion of the length of the air lance along which the nozzle(s) is positioned. This uniformity of air flow velocity emitted from the air lance along its length can result in a high degree of uniformity in the embossed pattern across essentially the entire width of fabric 111.

It is also desirable, according to the invention, to supply a sufficient flow of air to the inlet of the air lance to create a stream of air emitted from the nozzle(s) having an air flow velocity of at least about 12,000 feet per minute. In other preferred embodiments, sufficient air flow is supplied so that the velocity of air exiting the nozzle(s) of the air lance is at least about 15,000 feet per minute, in other embodiments at least about 20,000 feet per minute, and in yet other embodiments at least about 25,000 feet per minute. Such air flow velocities are substantially higher than those employed or achievable by conventional prior art air embossing systems and enable the inventive system to produce extremely finely detailed embossed patterns. The air flow velocity through the nozzle(s) of the air lances according to the invention can be easily determined by an operator of the system based upon the total open area of the nozzle(s), a measured inlet pressure of the air supply to the air lance, and performance charts typically supplied by the manufacture of the air blower utilized to supply is air to the air embossing system. Such measurements and determinations are routine for those of ordinary skill in the art.

Figure 6A:
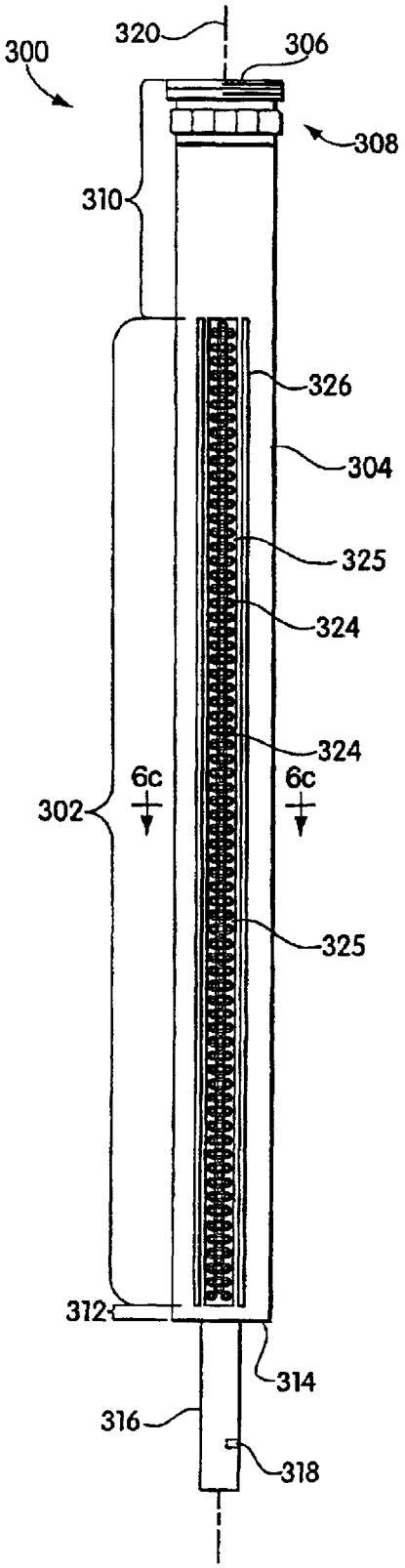
FIG. 6*a* is a schematic illustration of an air distribution lance for use in an air embossing process according to one embodiment of the invention, as viewed from the bottom.

FIG. 6*a* illustrates an alternative embodiment of an air lance, according to the invention. Air lance 300, as shown in FIG. 6*a*, has a nozzle region 302 of main body portion 304 positioned so that it is facing the observer. FIG. 6*b* shows air lance 300 in a side view. Air lance 300 comprises a conduit having a main body portion 304 and includes an inlet opening 306 and a threaded inlet connector 308, allowing attachment of the air lance to air supply line 114 of the air embossing system when it is in operation. Main body portion 304 is essentially constant in diameter along its entire length. Main body portion 304 includes an inlet region 310 upstream of nozzle region 302 and may, optionally, include a small end region 312 downstream of nozzle region 302 and upstream of sealed end 314 of the main body portion. In alternative embodiments, air lance 300, or any other air lance illustrated herein, may, instead of having a single inlet opening for attachment to the air supply, have each of its ends open for fluid communication and attachable to an air supply. Affixed to downstream end 314 of main body portion 304 is mounting shaft 316 including an alignment slot 318 (seen most clearly in FIG. 6*b*), which mounting shaft typically has a diameter that is smaller than the diameter of main body portion 304.

When mounted in an operable configuration within air embossing system 109, inlet region 310 is disposed upon air lance inlet cradle 154 (see FIG. 4*a*) such that at least inlet connector 308 extends beyond air lance inlet support 150, so as to be easily connectable to air supply line 114. Air lance 300 is disposed within embossing cylinder 112 and extends across the entire width of the embossing cylinder so that mounting shaft 316 is disposed within air lance mounting tube support clamp 180 of the air embossing system (see FIG. 4*b*), when the air lance is configured for operation. Typically, for preferred embodiments where it is desired that nozzle region 302 be positioned so that it is bisected by center line 190 of embossing cylinder 112, alignment slot 318 is configured to be engageable, when the air lance is in the above-described mounting position, with perpendicular alignment set screw 194, thus allowing the perpendicularly aligned position of the nozzle to be easily ascertained and securely maintained during operation.

Nozzle region 302 of air lance 300 extends along main body portion 304 in a direction essentially parallel to longitudinal axis 320 of the air lance so that it is located within, and is essentially coextensive with, the width of stencil region 128 of embossing cylinder 112, when the air lance is installed in an operable configuration. Accordingly, nozzle region 302 is also configured to extend across essentially the entire width of the embossable surface 113 fabric 111, when in operation.

In the embodiment illustrated, nozzle region 302 is about 54 inches to about 64 inches in length, inlet region 310 is about 24 inches to about 28 inches in length, end region 312 is about 1 inch to about 4 inches in length, and mounting shaft 316 is about 13 inches to about 15 inches in length and is about 2 inches to about 3 inches in outer diameter.

Nozzle region 302 includes therein a plurality of individual nozzles 324, which, in the illustrated embodiment comprise a plurality of circular holes within main body portion 304. In the illustrated embodiment, nozzles 324 comprise holes bored directly into the side wall of main body portion 304; however, in alternative embodiments, nozzles 324 may be formed in a separable plate element, which is attachable by screws or other fasteners to main body portion 304. Also, in other embodiments, the holes 324 comprising the nozzles may be arranged of positioned differently within nozzle region 302 than that shown. For example, in one alternative embodiment, the nozzles may be arranged in a single row within the nozzle region.

Because nozzle region 302, in the illustrated embodiment, includes nozzles 324 comprising of a plurality of individual holes separated by regions 325 of main body portion 304, which regions 325 are impermeable to air flow, it is preferred that nozzle region 302 be separated from inner surface 218 of stencil 128 (see FIG. 5) by at least about 0.75 inch. In the illustrated embodiment, since the outer diameter of main body portion 304 is essentially constant (typically about 4 inches to about 5¼ inches), as previously discussed in the context of FIG. 5, it is not possible to position nozzles 324 any closer to inner surface 218 of stencil 128 than distance 120 (e.g., about 1.2 in, as illustrated). In order to reduce dispersion when nozzles 324 are separated by such relatively large distances, main body portion 304 preferably includes flaps 326 installed on each side of nozzle region 302. The flaps are preferably flexible, so that they do not prevent insertion of the air lance through the flanged region 130 of the embossing cylinder 112, and so that after insertion into the embossing cylinder, they extend downward from main body portion 304 by a distance preferably approximately equal to the distance separating nozzles 324 from the internal surface of the stencil region of the embossing cylinder.

In order to improve the collimation of air flow from nozzles 324 and the distribution of air velocity along the length of nozzle region 302, it is preferred that nozzles 324 have a characteristic dimension, characterized by the diameter of the holes comprising nozzles 324, that does not exceed about 0.2 in, as was discussed above in the context of air lance 210 illustrated in FIG. 5. In other preferred embodiments, the characteristic dimension of nozzles 324 does not exceed about 0.1 in, in other embodiments does not exceed about 0.05 in, in yet other embodiments does not exceed about 0.01 in, in other embodiments does not exceed about 0.005 in, and in yet other preferred embodiments does not exceed about 0.001 in.

Figure 6C:
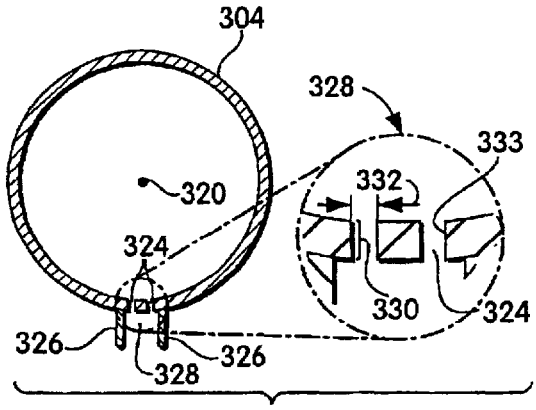
FIG. 6*c* is a cross-sectional view of the air distribution lance of FIG. 6*a;*

Air lance 300 is shown in cross section in FIG. 6*c*. Nozzle region 302 is shown magnified in figure insert 328 of FIG. 6*c*. FIG. 6*c* illustrates one preferred embodiment for providing nozzles 324 having a characteristic nozzle length 330 which exceeds the characteristic orifice dimension 332 of the nozzle. In the illustrated embodiment, characteristic nozzle length 330 is essentially equal to the wall thickness of main body portion 304. Thus, in the embodiment illustrated in FIG. 6*c*, it is preferred that the diameter of nozzles 324 be no greater than, and preferably less than, the wall thickness of main body portion 304. In general, the "characteristic nozzle length," as used herein in the context of the air lances provided according to the invention, refers to the maximum dimension of the nozzle as measured in a direction that is essentially parallel to the overall direction of air flow within the nozzle (i.e., in a direction that is typically essentially perpendicular to the longitudinal axis of the air lance). By providing nozzles having a characteristic nozzle length that exceeds the characteristic orifice dimension of the nozzle, the inventive air lances can significantly reduce the proportion of the air stream that is emitted from the nozzle in a diagonal direction with respect to the inner surface of the stencil, the surface of the fabric, and the longitudinal axis of the air lance. For an embodiment where the nozzles are in the form of circular holes having characteristic nozzle lengths approximately equal to the diameter of the holes forming the nozzle, it is apparent that essentially the entire stream of air directed towards the inner surface of the stencil through each nozzle will be directed through the nozzle at an angle of at least about 45 degrees with respect to the longitudinal axis of the air lance, when the system is in operation Any component of the air stream forming an angle less than 45 degrees with respect to the longitudinal axis will impinge upon a sidewall (e.g., walls 333 shown in FIG. 6*c*) and will be deflected towards the surface of the stencil at an angle with respect to the longitudinal axis of the air lance of at least about 45 degrees. In even more preferred embodiments, the characteristic length 332 of nozzles 324 exceeds the characteristic orifice diameter 332 by at least a factor of about 2, in more preferred embodiments by at least a factor of about 3, and in the most preferred embodiments, by at least a factor of about 4.

Figure 6D:
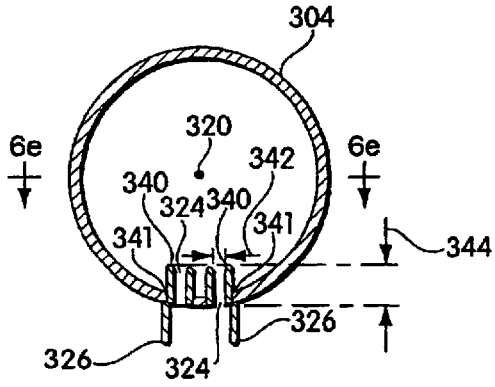
FIG. 6*d* is a cross-sectional view of a first alternative embodiment of the air distribution lance of FIG. 6*a;*
Figure 6E:
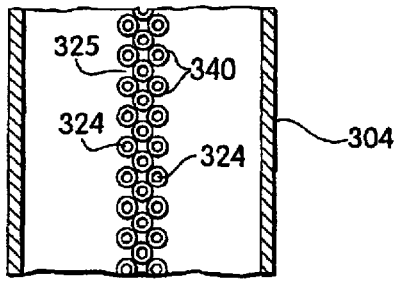
FIG. 6*e* is a cross-sectional view of a first alternative embodiment of the air distribution lance of FIG. 6*a;*
Figure 6B:
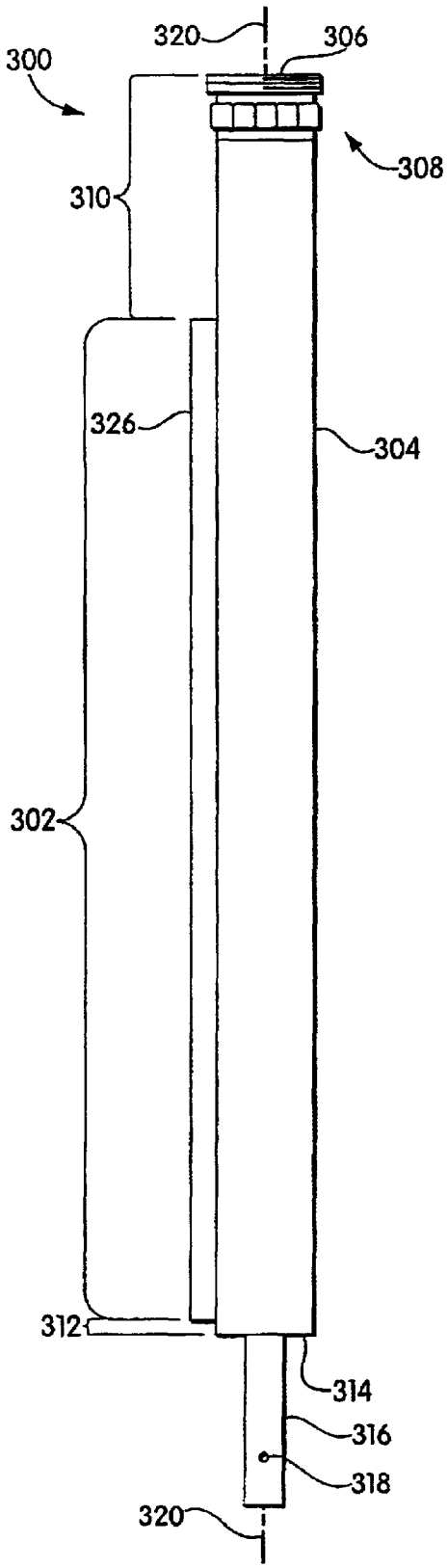
FIG. 6*b* is a schematic illustration of the air distribution lance of FIG. 6*a*, as viewed from the side.

FIG. 6*d* and FIG. 6*e* show cross sectional views of an alternative embodiment of air lance 300 that includes a plurality of air redirecting elements 340 that are shaped and positioned to intercept and deflect the air flow within main body portion 304 so that a greater fraction of the air flow is directed essentially perpendicular to longitudinal axis 320 and to the embossable surface 113 of fabric 111, when the air embossing system is in operation. As discussed above, in preferred embodiments, air directing elements 340 preferably intercept and direct the air flow so that essentially all of the air flow exits from nozzles 324 toward the fabric in a direction making an angle of at least about 45 degrees with respect to longitudinal axis 320 of the air lance. Air redirecting elements 340 comprise a series of baffles that may be formed of a wide variety of materials and may comprise a variety of structures able to: deflect and redirect air flow. An "air redirecting element", "air flow redirecting element," or "baffle" as used herein refers broadly to any element positioned within an air lance, which is shaped, positioned, and configured such that at least a portion of the flow of air supplied to the air lance impinges upon and is redirected by the element from an initial air flow direction forming an angle of less than about 45 degrees with respect to the longitudinal axis of the air lance to a subsequent air flow direction forming an angle greater than about 45 degrees with respect to the longitudinal axis of the air lance.

In the embodiment illustrated in FIGS. 6*d* and 6*e*, air flow redirecting elements 340 comprise a plurality of tubular inserts positioned within outlet openings 341 of main body portion 304. Air redirecting elements 340 have an outer diameter that is equal to or slightly less than the diameter of outlet openings 341, such that they may fit snuggly and securely within outlet openings 341, when installed as shown in FIG. 6*d*. Air redirecting elements 340 can, in some embodiments, be press fit into outlet openings 341 or, for improved stability, may be welded to main body portion 304, once they are inserted into outlet openings 341. Alternatively, air redirecting elements 340 may be welded, or otherwise attached within main body portion 304 adjacent and in fluid communication with outlet openings 341, without actually being inserted into the outlet openings.

Nozzles 324, as illustrated, have a characteristic orifice dimension 342 essentially equal to the internal diameter of air directing elements 340 and have a characteristic nozzle length 344 essentially equal to the length of air directing elements 340, as measured in a direction perpendicular to longitudinal axis 320 of the air lance. In alternative embodiments, air directing elements 340, instead of being press fit within outlet openings 341 of main body portion 304, may have an inner diameter equal to or greater than the diameter of outlet openings 341 and may be attached to an inner surface of main body portion 304 above outlet openings 341, as described above, such that the characteristic nozzle length comprises the sum of the wall thickness of main body portion 304 plus the length of an air redirecting element 340, as measured along a direction perpendicular to longitudinal axis 320. In such alternative embodiments, it is preferred that a substantial fraction of both (i.e., at least 50%) of the characteristic length of the nozzle be comprised of the length of the air redirecting element, as measured in a direction essentially perpendicular to the longitudinal axis of the main body.

Referring again to the embodiment shown in FIGS. 6*d* and 6*e*, in preferred embodiments, the length 344 of air redirecting elements 340, as measured in a direction that is essentially perpendicular to longitudinal axis 320, exceeds characteristic orifice dimension 342 of nozzles 324 by a factor of at least about 2, more preferably a factor of at least about 3, and most preferably by a factor of at least about 4.

Figure 6F:
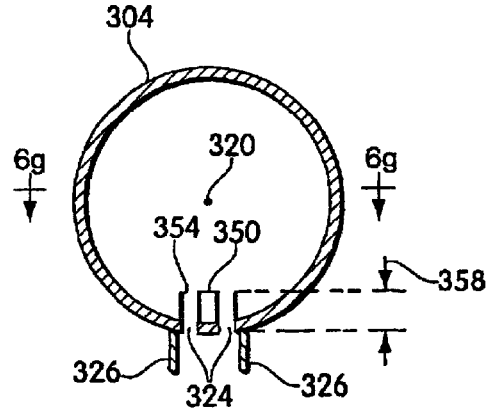
FIG. 6*f* is a cross-sectional view of a second alternative embodiment of the air distribution lance of FIG. 6*a;*
Figure 6G:
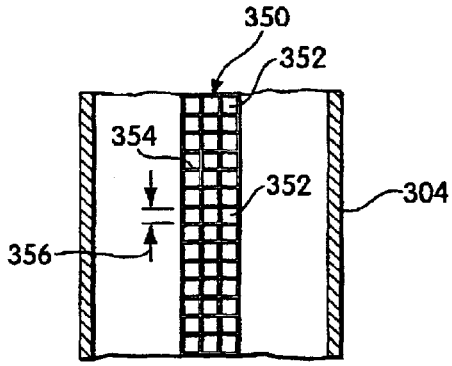
FIG. 6*g* is a cross-sectional view of a second alternative embodiment of the air distribution lance of FIG. 6*a;*

FIGS. 6*f* and 6*g* illustrate a cross-sectional view of another alternative embodiment of air lance 300 including a main body portion 304 including therein a single, monolithic air redirecting element 350. A "monolithic" air redirecting element, as used herein, refers to an air redirecting element having a plurality of surfaces for redirecting or deflecting air, wherein the surfaces are formed within a single, undivided piece of material, or comprise a plurality of physically distinct elements that are interconnected together so as to form a continuous structure. Air redirecting element 350 is preferably positioned within main body portion 304 and attached to an internal surface of the main body portion by welded attachments, or other means of fastening, as would be apparent to those of ordinary skill in the art. Air redirecting element 350 has an overall width and length sufficient to essentially completely cover and be coextensive with nozzle region 302 of air lance 300. Air redirecting element 350 performs an essentially equivalent function as that previously described for air redirecting elements 340 in the context of FIGS. 6*d* and 6*e* above. Air redirecting element 350 can comprise a wire or fabric mesh, screen, grate, or any other suitable structure, as would be apparent to those of ordinary skill in the art. Air redirecting element 350, as illustrated in FIG. 6*g*, can comprise a grate-like structure having a plurality of cells 352, which form air flow channels that are oriented essentially perpendicularly to longitudinal axis 320 of the air lance. Cells 352 are separated one from another by a series of walls of structure 350 forming dividers 354. Distance 356, is the characteristic dimension of channels 352. In general, the "characteristic dimension" of a channel in a monolithic air redirecting element, as used herein, is defined as the largest cross-sectional dimension of the channel as measured along a direction essentially parallel to the longitudinal axis of the air lance.

The monolithic baffle 350 illustrated in FIGS. 6*f* and 6*g* has channels 352 comprising a plurality of square conduits arranged in a grid pattern However, in alternative embodiments, the monolithic air redirecting element may have channels comprising a plurality of cells having cross-sectional shapes other than square. In one preferred embodiment, monolithic air redirecting element 350 comprises a honeycomb-like structure, described in more detail below in the context of FIG. 9, having a plurality of hexagonally shaped cells arranged in a honeycomb-like pattern.

In preferred embodiments, the height 358 of air redirecting element 350, as measured in a direction essentially perpendicular to the longitudinal axis of the air lance, exceeds characteristic dimension 356 by a factor of at least about 2, more preferably by a factor of at least about 3, and most preferably by a factor of at least about 4. Air redirecting element 350, when it is constructed and positioned as shown in FIGS. 6*f* and 6*g* functions to increase the fraction of air flow through nozzles 324 that is directed essentially perpendicularly to the longitudinal axis 320 of the air lance and essentially perpendicularly to the surface of the fabric being embossed, when the air embossing system is in operation. In other words, the monolithic air redirecting elements provided in the embodiment illustrated in FIGS. 6*f* and 6*g*, and in other embodiments of the inventive air lances described below, increase the fractional amount the stream of air directed through apertures or openings in the stencil of the air embossing system that is oriented in a direction essentially perpendicular to the embossable surface of the fabric being embossed, when the air lance is in operation, when compared to the fractional amount of a stream of air directed through the openings in the stencil essentially perpendicular to the embossable surface of the fabric by an essentially equivalent air lance, but without the air redirecting element included therein.

Air lance 500 illustrated in FIGS. 7*a*–7*d* represents an alternative, although less preferred, embodiment for providing certain of the benefits of air lance 220, discussed above in the context of FIG. 5, and air lance 700, discussed below in the context of FIGS. 8*a*–8*f*. Specifically, air lance 500 is configured to provide a nozzle that can be positioned in close proximity to the internal surface of an embossing stencil and in close proximity to the surface of an embossable fabric. Air lance 500, when installed in air embossing system 109 similarly to the installation shown previously for air lance 220 in FIG. 5, can be positioned with respect to interior surface 218 of stencil 128 (see FIG. 5) so that its nozzle 502 is positioned from surface 218 at a distance that is less than distance 220 defining the overhang distance between the internal surface of the stencil and the internal surface of the embossing cylinder in flange region 130 (or the internal surface of aperture 148 of air embossing system 109, whichever creates a larger overhang distance 220). Nozzle 502 may be positioned at distances with respect to surface 218 that are similar to the preferred distances separating surface 218 and nozzle 216 of air lance 210 described above in the context of FIG. 5.

Air lance 500 comprises a main body portion 504 including, in preferred embodiments, a single, slit-shaped nozzle 502 extending along a substantial fraction of the length of main body portion 504 and defining nozzle region 506. In alternative, less preferred, embodiments, the air lance may include a plurality of nozzles comprising individual holes instead of a single, slit-shaped nozzle. As discussed above for air lances 210 and 300, the nozzle region preferably extends across essentially the entire width of embossing cylinder stencil region 128 and embossable surface 113 of fabric 111, when the air lance is positioned within air embossing system 109 for operation.

Nozzle 502, in preferred embodiments, has a characteristic orifice dimension, defined by width 508 of the slit, that is less than about 0.2 inch and preferably falls within the preferred range discussed above for nozzle 216 of air lance 210. In the illustrated embodiment, slit width 508 is essentially constant along the entire length of nozzle region 506. In alternative embodiments, slit 502 may be tapered so that slit width 508 changes along the length of the nozzle. For example, in some such embodiments, slit 502 may be wider at the end of the nozzle nearest offset inlet tube 510 than at the end nearest offset mounting shaft 512. Such a configuration, especially for nozzles having relatively large characteristic orifice dimensions, may improve the uniformity of air flow velocity along the length of nozzle region 506.

Figure 7A:
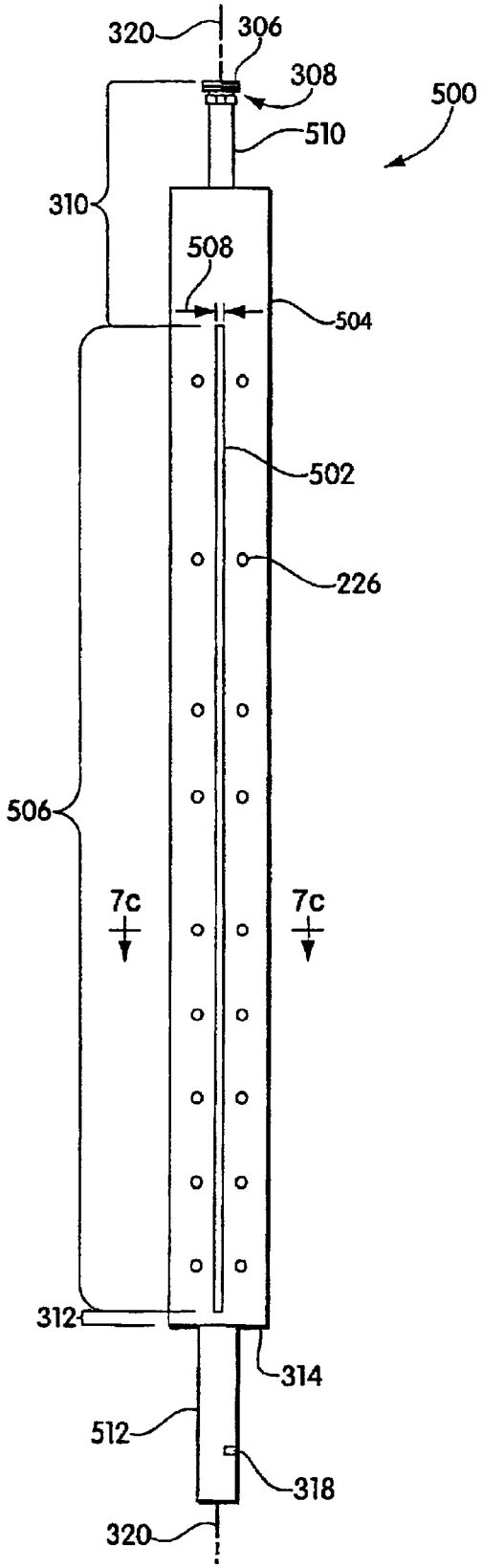
FIG. 7*a* is a schematic illustration of an air distribution lance for use in an air embossing process according to another embodiment of the invention, as viewed from the bottom.
Figure 7C:
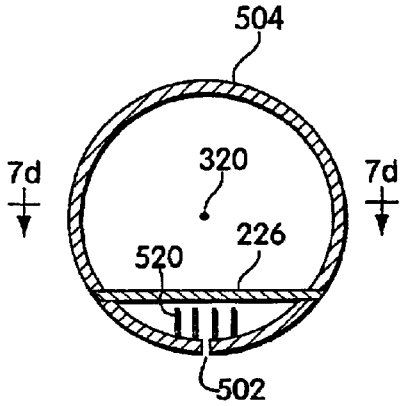
FIG. 7*c* is a cross-sectional view of the air distribution lance of FIG. 7*a;*
Figure 7D:
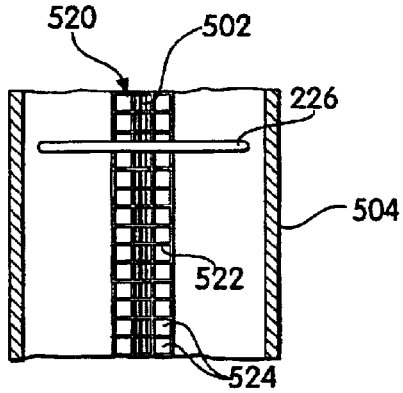
FIG. 7*d* is a cross-sectional view of the air distribution lance of FIG. 7*a;*
Figure 7B:
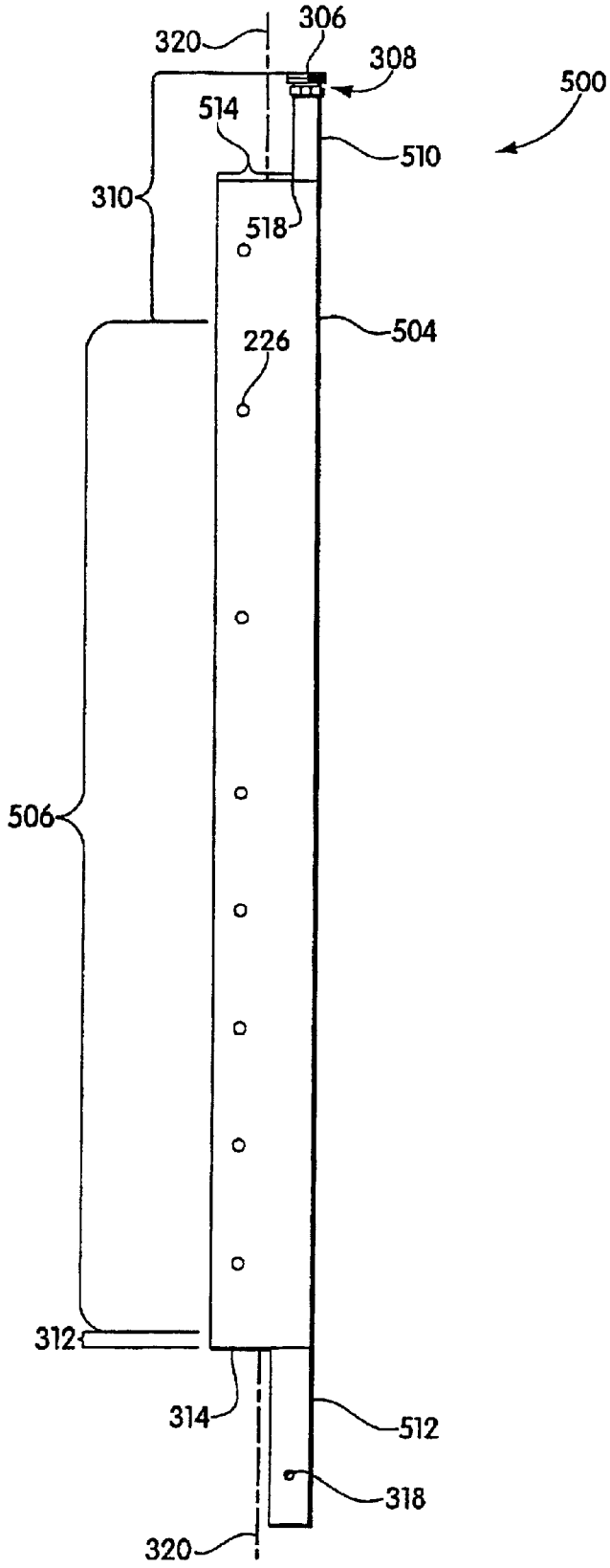
FIG. 7*b* is a schematic illustration of the air distribution lance of FIG. 7*a*, as viewed from the side.

Referring now to FIG. 7*b*, a side view of air lance 500 shows that inlet tube 510 and mounting shaft 512 have centers that are offset with respect to longitudinal axis 320 of the air lance. Inlet tube 510 also has a smaller diameter than main body portion 504 of air lance 500. Providing a reduced diameter inlet tube, which is offset with respect to longitudinal axis 320, enables the provision of an overhang region 514, which enables nozzle 502 to be positioned within embossing cylinder 112 so that it is able to be placed in a desirably close proximity to the internal surface 218 of stencil 128 (see FIG. 5). For embossing cylinders and embossing systems having the dimensions and configuration described previously in the context of FIGS. 4 and 5, air lance 500 can be configured, as in the illustrated embodiment, with a main body portion 504 having an outside diameter of about 5¼ inches, and having an offset inlet tube, as illustrated, having an outside diameter of no more than about 2.8 inches. This configuration provides an overhang distance 514 of at least about 1.2 inches, sufficient to completely traverse distance 220 shown above in FIG. 5.

It is to be understood that for embodiments of an air embossing system utilizing an air lance similar to air lance 500, inlet tube 510 will need to be of sufficient length so that upstream surface 518 of main body portion 504 is positioned within embossing cylinder 112 so that it is completely contained within the large internal diameter portion of the embossing cylinder, when configured for operation. Also, air lance inlet support arm 150 of air embossing system 109 (see FIG. 4*a*) should be configured so that air lance inlet cradle 154 is shaped and sized to conform to the smaller size of inlet tube 510 of air lance 500.

A cross-sectional view of a preferred embodiment of air lance 500 is shown in FIGS. 7*c* and 7*d*. Preferably, in order to maintain a constant characteristic orifice dimension upon pressurization of air lance 500 during operation, main body portion 504 is stabilized by one or more support struts 226, as described above in the context of air lance 210 in FIG. 5. In addition, preferred embodiments of air lance 500, the lance also includes a monolithic air redirecting element or baffle 520 that can be essentially similar in configuration and function to air redirecting element 350 described above in the context of FIGS. 6*f* and 6*g*.

For embodiments where nozzle 502 is positioned in close proximity to the internal surface of the embossing stencil (e.g., at distances of less than about 0.75 inch) it is preferred that the thickness of the walls or dividers 522 of structure 520 separating each of the cells or channels 524 be less than the characteristic orifice dimension of nozzle 502. It has been found, in the context of the present invention, that if wall thickness 522 exceeds the characteristic orifice dimension of nozzle 502 that undesirable, visually apparent artifacts may be created in the embossed pattern of a fabric embossed using the air lance. Accordingly, in preferred embodiments, it is preferred that the thickness of walls 522 of structure 520 be less than, and preferably substantially less than, the characteristic orifice dimension of nozzle 502. In the most preferred embodiment, the thickness of walls 522 is preferably minimized such that it is as small as possible, while maintaining the structural integrity of baffle 520 in operation. For aluminum honeycomb-like structures, such as baffle 800 shown in FIG. 9, it is preferred that the thickness of the walls not exceed about 0.002 inch. In other embodiments, the wall thickness of walls forming a monolithic baffle comprising an aluminum honeycomb-like structure may be as small as about 0.001 inch or less.

FIGS. 8*a*–8*f* illustrate a preferred embodiment of an air lance 700 essentially similar in configuration to air lance 210 described previously in the context of FIG. 5, except including a nozzle forming component 702 configured to contain one or more air redirecting elements or baffles therein. Elements which are essentially identical to those described previously for air lance 210 are labeled in FIGS. 8*a*–8*f* using the same figure labels. Similarly, and as with air lance 500 of FIGS. 7*a*–7*d*, components essentially equivalent to or similar to those illustrated and discussed in the context of air lance 300 shown in FIGS. 6*a*–6*g* are also labeled with the same figure labels as those used in FIGS. 6*a*–6*g*.

Figure 8A:
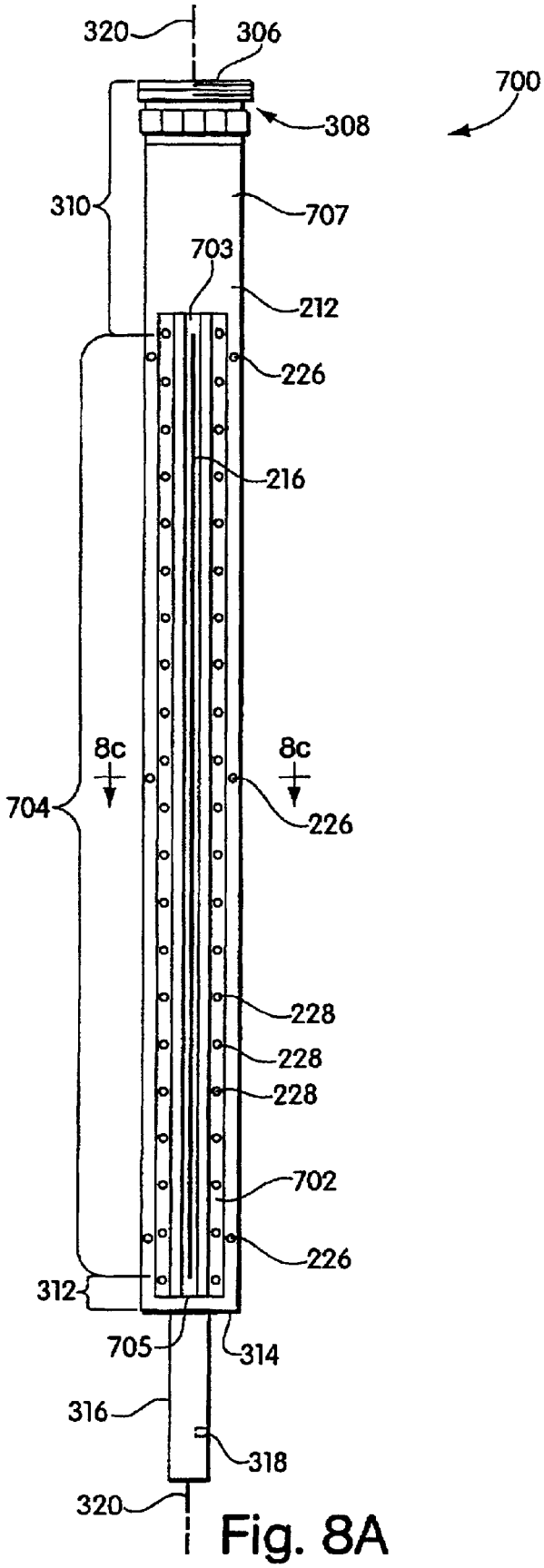
FIG. 8*a* is a schematic illustration of an air distribution lance for use in an air embossing process according to yet another embodiment of the invention, as viewed from the, bottom.
Figure 8B:
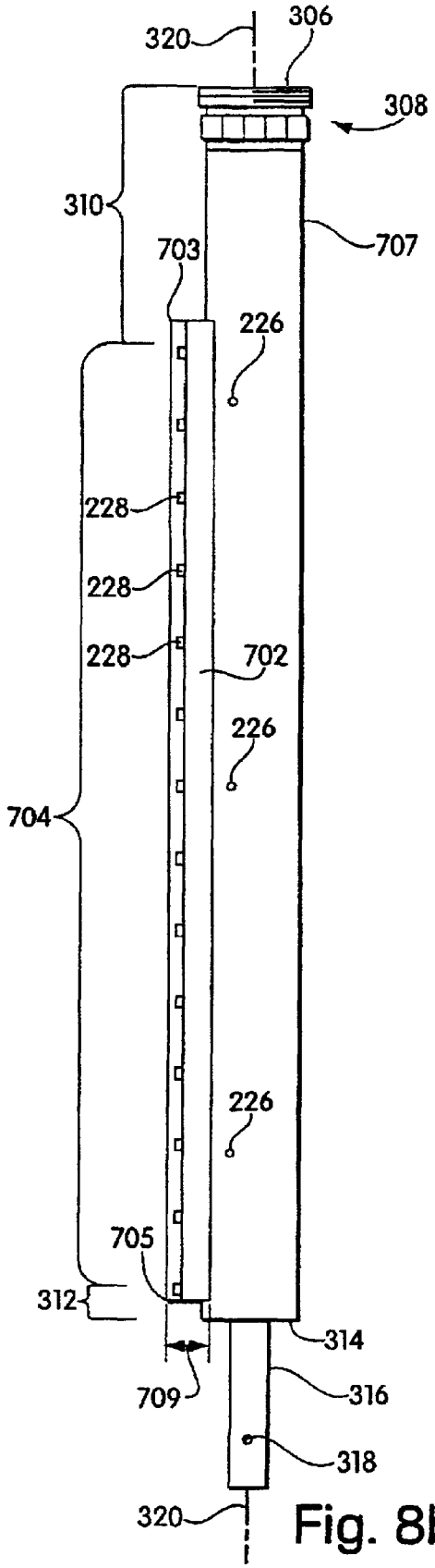
FIG. 8*b* is a schematic illustration of the air distribution lance of FIG. 8*a*, as viewed from the side.

Referring to FIG. 8*a*, nozzle forming component 702 includes, machined therein, a nozzle slit 216, which extends along the majority of its length except for regions 703 and 705 at its upstream and downstream ends respectively. Nozzle forming component 702 preferably is sized so that it projects beyond an outermost surface 707 (see FIG. 8*b*) of main body portion 212 by a distance 709 that is equal to or greater than distance 220 shown and discussed above in the context of FIG. 5, thus, enabling nozzle 216 to be positioned as close to surface 218 of stencil 128 as is desired during operation.

Nozzle slit 216 can be formed in nozzle forming component 702 by a variety of conventional machining methods, as would be apparent to those of ordinary skill in the art, including, but not limited to, cutting with a blade, water jet cutting, laser cutting, etc. For embodiments involving extremely narrow slits, for example nozzles having a characteristic orifice dimension less than about 0.02 inch, nozzle forming component 702, instead of being formed of a unitary, monolithic structure having slit 216 machined therein, may instead comprise two separable components, each separable component being mounted on opposite sides of outlet opening 224 of main body portion 212 (see FIG. 8*c*) such that they are positioned adjacent and separated from each other on the main body portion, for example by the use of very thin shim(s) or spacer, so that the distance between the adjacent facing surfaces of the two components defines a slit forming a nozzle having a characteristic nozzle orifice dimension essentially equal to the width of the shim(s) or spacers utilized to separate the two subcomponents of the nozzle forming component during mounting to the main body portion. In addition, as discussed previously for the prior air lances provided according to the invention, air lance 700 includes a nozzle region 704, having a length defined by the length of nozzle 216, which nozzle region extends across essentially the entire width of stencil 128 and embossable surface 113 of embossable fabric 111, when air lance 700 is positioned within air embossing system 109 for operation.

Figure 8C:
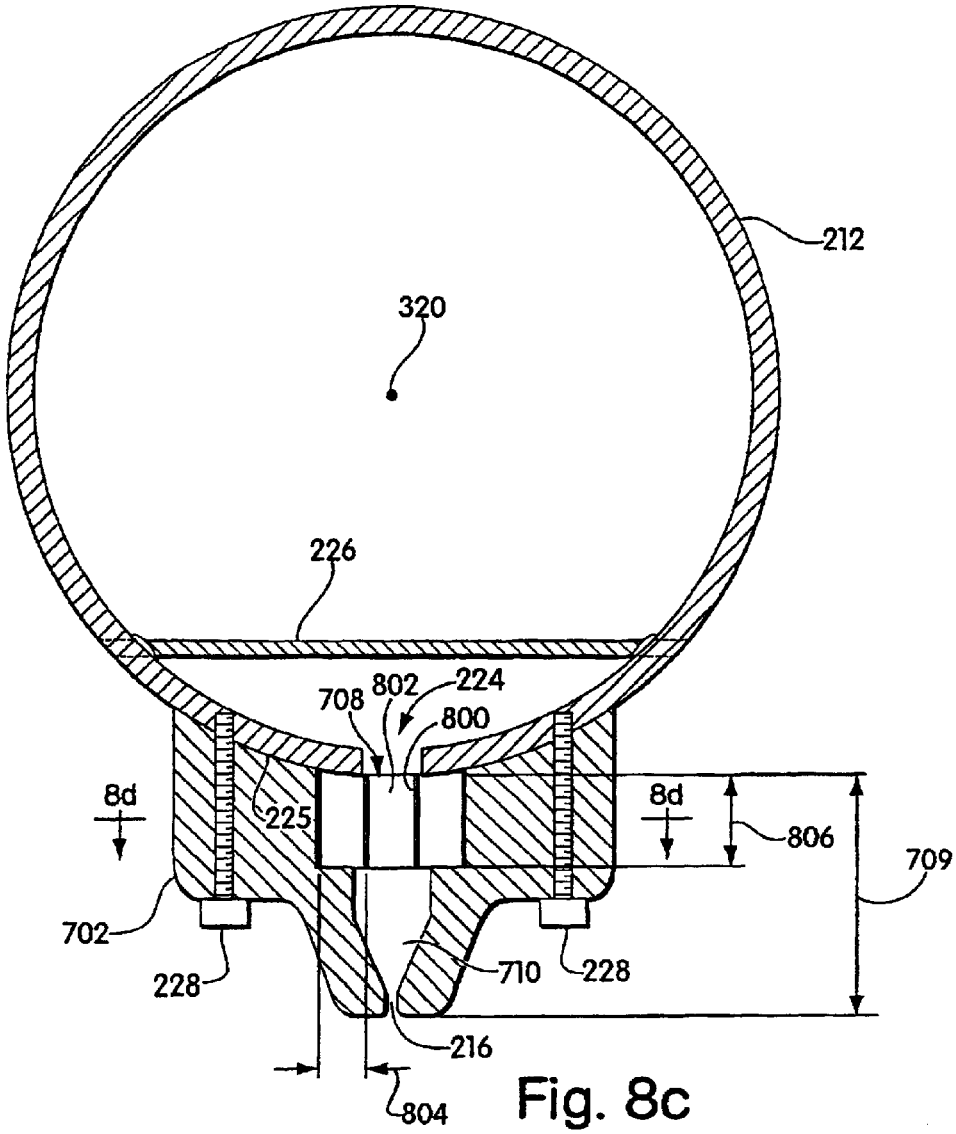
FIG. 8*c* is a cross-sectional view of the air distribution lance of FIG. 8*a;*
Figure 8D:
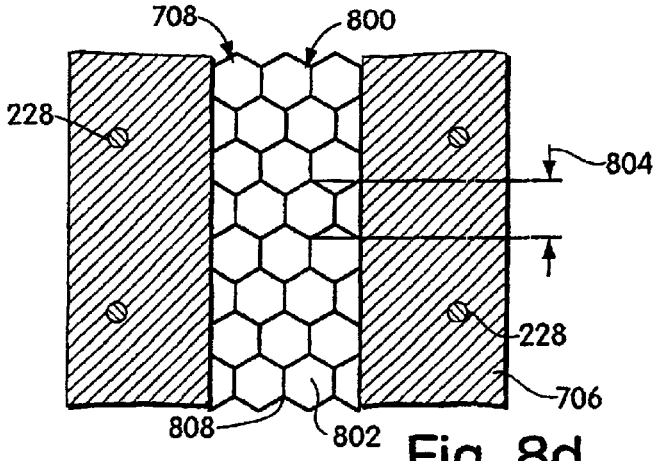
FIG. 8*d* is a cross-sectional view of the nozzle-forming component of the air distribution lance of FIG. 8*a;*

FIG. 8*c* presents a cross-sectional view of air lance 700 illustrating one preferred embodiment for providing an air redirecting element 800 within nozzle forming component 702. Nozzle forming component 702 includes a hollow chamber 708 therein for containing air directing element 800 and further includes, downstream of hollow chamber 708, a tapered chamber 710, which serves to further direct and focus air flow within the nozzle forming component toward slit nozzle 216. Main body portion 212 includes an outlet opening 224 comprising an elongated slot disposed along the length of the main body portion essentially coextensive with and parallel to slit nozzle 216. Hollow chamber 708 and tapered chamber 710 extend along the length of nozzle forming component 702 so that they are essentially coextensive with slit nozzle 216 and elongated slot 224 in main body portion 212.

Figure 9A:
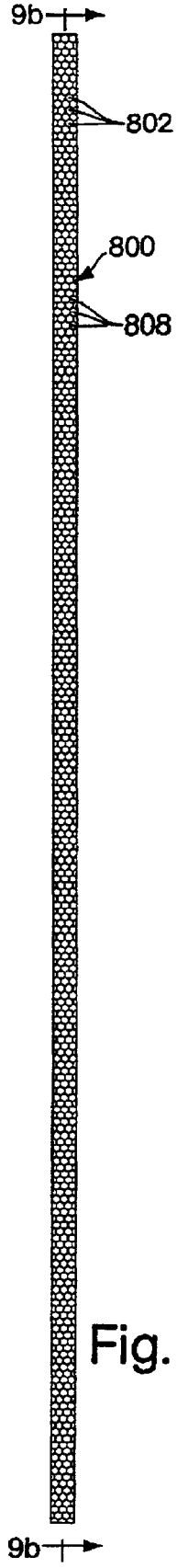
FIG. 9*a* is a schematic illustration of the air redirecting element of the air lance of FIG. 8*a; and*
Figure 9B:
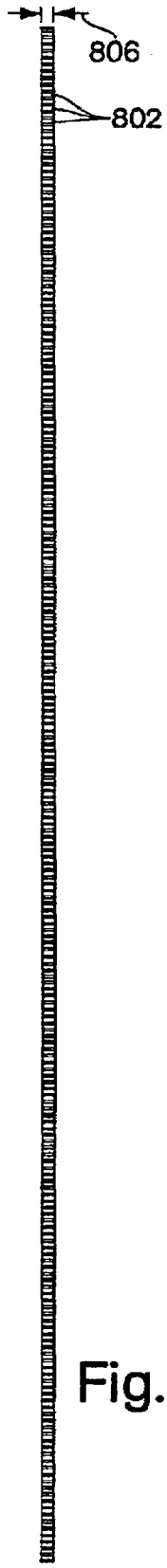
FIG. 9*b* is a cross-sectional view of the air redirecting element of FIG. 9*a.*

Air redirecting element 800, in the illustrated embodiment, comprises a monolithic aluminum honeycomb-like structure, shown in more detail in FIG. 9 and discussed above in the context of FIGS. 6 and 7. As shown most clearly in FIG. 8*d* and FIGS. 9*a* and 9*b*, air redirecting element 800 comprises a plurality of hexagonally shaped cells 802 with a characteristic dimension 804 and a height 806. In one embodiment, air redirecting element 800 comprises an aluminum honeycomb structure including a plurality of hexagonally shaped cells 802 each having a characteristic dimension of about ⅛ inch and a height of about ½ inch. Preferably, as discussed previously with respect to monolithic air redirecting elements 520 and 350, the thickness of the walls 808 of the structure separating cells 802 is less than the characteristic orifice dimension of nozzle 216. In one illustrative embodiment, the thickness of walls 808 is about 0.002 inch, and in another illustrative embodiment, the thickness is about 0.001 inch Referring again to FIG. 8*c*, hollow chamber 708 preferably is sized and shaped to snuggly accommodate monolithic air redirecting element 800 in order to prevent vibration and motion of the air redirecting element during operation of the air lance. For added stability, in some embodiments, air redirecting element 800 may be welded, or otherwise affixed to one or more internal surfaces of hollow chamber 708 in order to further prevent motion of the element during operation. As illustrated in FIG. 8*c*, hollow chamber 708 is preferably located within nozzle forming component 706 so that air redirecting element 800 is positioned as far upstream of nozzle 216 as possible. Positioning air redirecting element 800 as far upstream as possible from nozzle 216 further acts to reduce potential artifacts within an embossed pattern of a fabric, which artifacts may be due to the presence of walls 808 separating the cells 802 of the air redirecting element.

Air redirecting element 800 is preferably installed in hollow chamber 708 so that channels 802 formed by the cells of the structure of the monolithic air redirecting element are aligned so that they are essentially perpendicular to longitudinal axis 320 of main body portion 212. In operation, air redirecting element 800 serves to redirect and deflect air flow within main body portion 212 so that a greater fraction of air flow emitted from nozzle 216 is directed essentially perpendicularly to longitudinal axis 320 and embossable surface 113 of fabric 111, as compared to that emitted from an essentially equivalent air lance but without air redirecting component 800 installed therein. It should be emphasized, that for embodiments involving air lances provided according to the invention utilizing nozzle forming components (e.g., air lance 210 shown in FIG. 5 and air lance 700 shown in FIG. 8) utilization of an air redirecting element is optional and may not be required, under some operating conditions, in order to yield desirable embossing performance, especially, for example, when using air lances with nozzles having a very small characteristic orifice dimension, for example, less than about 0.1 inch.

Figure 8E:
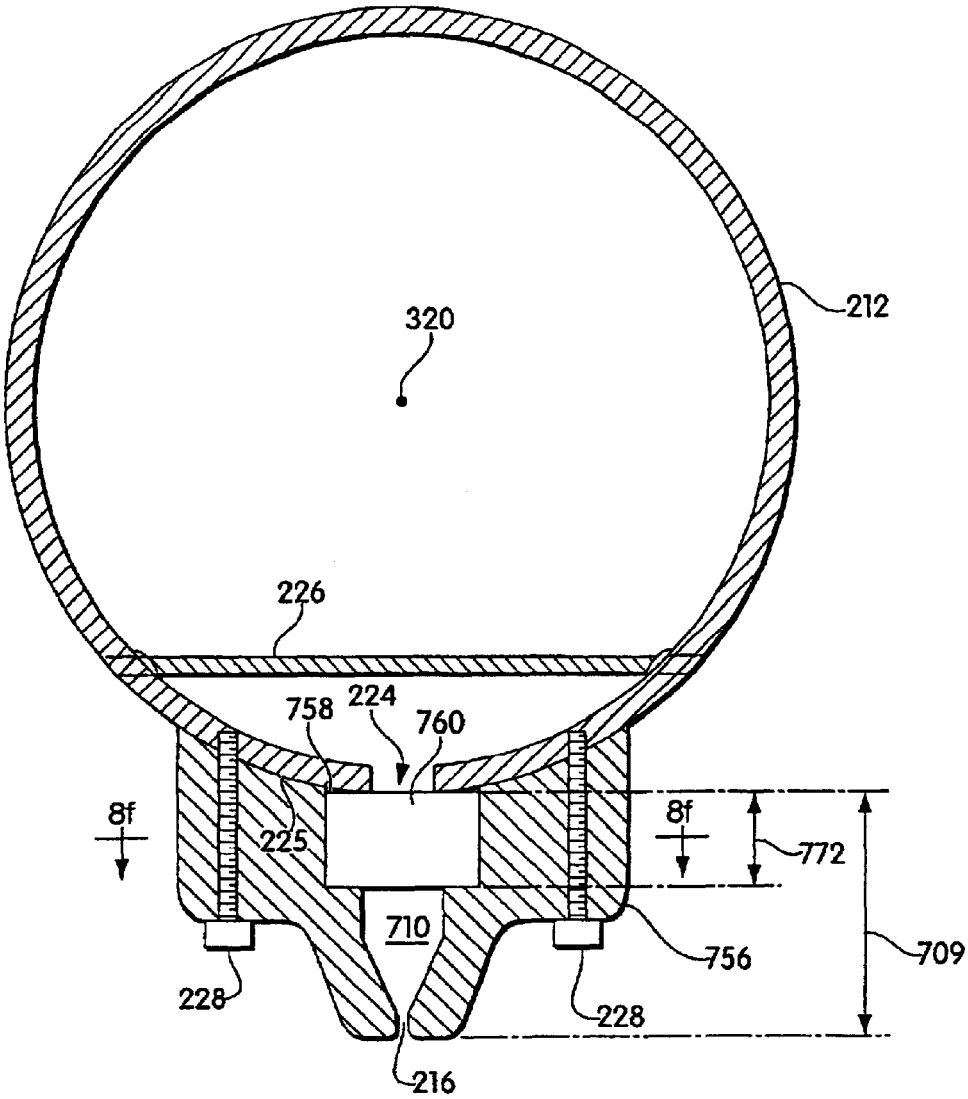
FIG. 8*e* is a cross-sectional view of an alternative embodiment of the air distribution lance of FIG. 8*a;*
Figure 8F:
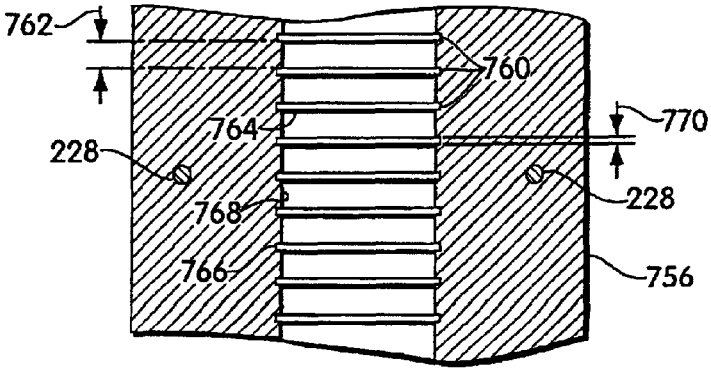
FIG. 8*f* is a cross-sectional view of the nozzle-forming component of the air distribution lance of FIG. 8*e;*

An alternative embodiment of air lance 700 providing a plurality of air redirecting elements is illustrated in the cross sectional views of FIGS. 8*e* and 8*f*. Nozzle forming component includes a hollow chamber 758 therein that contains a plurality of air redirecting elements 760 comprising a series of baffling vanes disposed along essentially the entire length of chamber 758 and spaced apart from each other at regular intervals defined by distance 762. Vanes 760 are preferably oriented within chamber 758 so that an air deflecting surface 764 of each vane is essentially perpendicular to longitudinal axis 320 of main body 212. As shown in FIG. 8*f*, nozzle forming component 756 preferably includes a plurality of spaced grooves 766 in sidewall 768 of chamber 758 for positioning and securing the edges of vanes 760 therein. Grooves 766 should have a width that is essentially equal to or slightly less than thickness 770 of vanes 760, such that when inserted into grooves 766 vanes 760 are essentially immobilized during operation of the air lance. In alternative embodiments, nozzle forming component 756 may include a chamber not including vane-mounting grooves therein, and the vanes may instead be secured to the sidewall of the chamber by welding or other affixing means, as would be apparent to those of ordinary skill in the art.

In preferred embodiments, thickness 770 of each of vanes 760, as measured in a direction essentially parallel to longitudinal axis 320 of main body portion 212, is less than the characteristic orifice dimension of slit nozzle 216. In one illustrative embodiment, thickness 770 of vanes 760 is less than about 0.02 inch, and in another illustrative embodiment is less than about 0.01 inch.

It is also preferred that the height 772 of each vane 760, as measured along a direction that is essentially perpendicular to longitudinal axis 320 of main body portion 212, exceeds the distance 762 between each of vane 760 by a factor of at least about 2, and, in more preferred embodiments exceeds the distance by a factor of at least about 3, and in the most preferred embodiments exceeds the distance by a factor of at least about 4. While several embodiments of air redirecting elements for redirecting air flowing within a air lance have been illustrated herein, those of ordinary skill in the art will readily envision a variety of other means and structures for providing air redirecting elements to perform the functions described herein, and each of such variations or modifications is deemed to be within the scope of the present invention.

More generally, those skilled in the art would readily appreciate that all parameters and configurations described herein are meant to be exemplary and that actual parameters and configurations will depend upon the specific application for which the systems and methods of the present invention are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described. The present invention is directed to each individual feature, system, or method described herein In addition, any combination of two or more such features, systems, or methods, provided that such features, systems, or methods are not mutually inconsistent, is included within the scope of the present invention.

What is claimed is:

1. An air lance for directing a gas through a stencil and onto a surface of an embossable fabric for embossing the fabric comprising:

a conduit having at least one inlet opening therein; and at least one orifice forming at least one nozzle, the nozzle being constructed and positioned to direct a stream of the gas through at least one opening in the stencil and onto the embossable surface of a fabric, when the air lance is in operation; and at least one air redirecting element constructed and positioned with respect to the nozzle so that the fractional amount of the stream of the gas directed through the opening in the stencil essentially perpendicular to the embossable surface of the fabric, when the air lance is in operation, is increased with respect to a fractional amount of a stream of the gas directed through the opening in the stencil essentially perpendicular to the embossable surface of the fabric by an essentially equivalent air lance, except not including the air redirecting element.

2. The air lance of claim 1, wherein the gas comprises air.

3. A system for embossing a surface of an embossable fabric comprising the air lance of claim 2.

4. The system of claim 3, further comprising:

a stencil, which has a first surface and a second fabric-facing surface that is positionable adjacent and in spaced proximity to an embossable surface of the fabric during air embossing; wherein the conduit forms a main body portion of the air lance; wherein the air lance is secured within the system to maintain the nozzle in a fixed, predetermined position relative to the first surface of the stencil during operation; and wherein the air lance is positioned within the system such that the nozzle is positioned with respect to the stencil so that at least a portion of the nozzle that is closest to the stencil is separated from the first surface of the stencil by a first distance, when the system is in operation, and so that the smallest distance separating the main body portion of the air lance from the first surface of the stencil exceeds the first distance.

5. The system of claim 4, wherein the first distance does not exceed about 0.5 inch, when the system is in operation.

6. The system of claim 5, wherein the first distance does not exceed about 0.25 inch, when the system is in operation.

7. The system of claim 6, wherein the first distance does not exceed about 0.1 inch, when the system is in operation.

8. The system of claim 7, wherein the first distance does not exceed about 0.05 inch, when the system is in operation.

9. The system of claim 8, wherein the first distance does not exceed about 0.025 inch, when the system is in operation.

10. The system of claim 9, wherein the first distance does not exceed about 0.0125 inch, when the system is in operation.

11. The system of claim 10, wherein the first distance is about 0.01 inch, when the system is in operation.

12. The system of claim 4, wherein the system further comprises adjustable air lance positioning means for enabling an operator of the system to adjust the first distance.

13. The system of claim 4, wherein at least a portion of the second fabric-facing surface of the stencil is positioned from the embossable surface of the fabric at a distance not exceeding about 0.02 inch.

14. The system of claim 13, wherein at least a portion of the second fabric-facing surface of the stencil is positioned from the embossable surface of the fabric at a distance not exceeding about 0.01 inch.

15. The system of claim 14, wherein at least a portion of the second fabric-facing surface of the stencil is positioned from the embossable surface of the fabric at a distance not exceeding about 0.005 inch.

16. The system of claim 15, wherein at least a portion of the second fabric-facing surface of the stencil is positioned from the embossable surface of the fabric at a distance of about 0.001 inch.

17. The system of claim 4, further comprising a support surface constructed and positioned to support the underside of the fabric during air embossing of the embossable surface of the fabric with the system.

18. The system of claim 17, wherein the support surface comprises a cylindrical roller.

19. The system of claim 4, wherein the stencil comprises a hollow rotatable cylinder with the air lance being at least partially disposed within the cylinder.

20. The system of claim 4, further comprising a first drive system constructed and arranged to rotate the stencil at at least a first speed; and a second drive system constructed and arranged to transport the fabric with respect to the position of the air lance at at least a second speed different from the first speed.

21. The system of claim 3, wherein the at least one nozzle has a characteristic orifice dimension less than about 0.2 inch.

22. The system of claim 21, wherein the at least one nozzle has a characteristic orifice dimension not exceeding a maximum characteristic nozzle length of the at least one nozzle.

23. The system of claim 4, wherein the inlet opening of the conduit is positioned in at least one end thereof and wherein the conduit further comprises at least one outlet opening in a side wall of the main body portion of the air lance comprising the at least one orifice forming the at least one nozzle.

24. The system of claim 4, wherein the inlet opening of the conduit is positioned in at least one end thereof and wherein the conduit further comprises at least one outlet opening in a side wall of the main body portion of the air lance, wherein the air lance includes a nozzle-forming component, which nozzle-forming component includes the at least one orifice therein forming the at least one nozzle, wherein the nozzle in the nozzle-forming component is in fluid communication with the outlet opening in the main body portion of the air lance and is constructed and positioned to direct a stream of air through the stencil and onto the embossable surface of the fabric, when the air lance is in operation, and wherein the nozzle forming component is shaped and positioned so that the nozzle in the nozzle-forming component is separated from the first surface of the stencil by a distance that is substantially less than a distance separating the first surface of the stencil and the outlet opening in the main body portion of the air lance, when the air lance is in operation.

25. The system of claim 21, wherein the at least one orifice forming the at least one nozzle is in the shape of an elongated slit.

26. The system of claim 24, wherein the at least one air redirecting element is positioned within the nozzle forming component and upstream of the at least one nozzle.

27. The system of claim 24, wherein the at least one outlet opening in the side wall of the main body portion of the air lance comprises an elongated slot.

28. The system of claim 27, wherein the at least one orifice in the nozzle-forming component comprises an elongated slit that is essentially parallel to the elongated slot in the main body portion of the air lance.

29. The system of claim 28, wherein the width of slot in the main body portion of the air lance exceeds the width of the slit in the nozzle-forming component.

30. The system of claim 28, wherein the nozzle forming component is elongated and is disposed over the slot in the main body portion of the air lance so that the slit in the nozzle forming component and the slot in the main body portion are essentially coextensive.

31. The system of claim 30, wherein the length of a nozzle region of the nozzle-forming component as measured along a direction parallel to the longitudinal axis of the main body portion of the air lance is at least as great as the width of the fabric being embossed by the air lance, when the system is in operation.

32. The system of claim 29, wherein the nozzle-forming component includes a hollow chamber upstream from and essentially coextensive with the elongated slit.

33. The system of claim 32, wherein the chamber contains at the least one air redirecting element therein.

34. The system of claim 33, wherein the at least one air redirecting element comprises a plurality of baffling vanes disposed along essentially the entire length of the chamber, affixed to the chamber to prevent motion of the vanes, and spaced along the length of the chamber at essentially regularly spaced intervals.

35. The system of claim 34, wherein the vanes are oriented so that an air deflecting surface of each vane is essentially perpendicular to the longitudinal axis of the main body portion of the air lance.

36. The system of claim 35, wherein the thickness of each of the vanes, as measured in a direction essentially parallel to the longitudinal axis of the main body portion of the air lance, is less than the characteristic orifice dimension of the slit in the nozzle-forming component.

37. The system of claim 36, wherein the thickness of each of the vanes, as measured in a direction essentially parallel to the longitudinal axis of the main body portion of the air lance, is less than about 0.002 inch.

38. The system of claim 37, wherein the thickness of each of the vanes, as measured in a direction essentially parallel to the longitudinal axis of the main body portion of the air lance, is less than about 0.001 inch.

39. The system of claim 34, wherein the height of each of the vanes as measured along a direction that is essentially perpendicular to the longitudinal axis of the main body portion of the air lance exceeds a distance between each vane by a factor of at least about 2.

40. The system of claim 39, wherein the height of each of the vanes as measured along a direction that is essentially perpendicular to the longitudinal axis of the main body portion of the air lance exceeds a distance between each vane by a factor of at least about 3.

41. The system of claim 40, wherein the height of each of the vanes as measured along a direction that is essentially perpendicular to the longitudinal axis of the main body portion of the air lance exceeds a distance between each vane by a factor of at least about 4.

42. The system of claim 33, wherein the at least one air redirecting element comprises a monolithic baffling structure having a plurality of channels therein, the monolithic baffling structure being oriented within the chamber so that the channels are oriented with their longitudinal axes essentially perpendicular to the longitudinal axis of the main body portion of the air lance.

43. The system of claim 42, wherein the monolithic baffling structure comprises an insert including a plurality of honeycombed cells comprising the channels.

44. The system of claim 43, wherein the thickness of walls of the structure separating each of the channels is less than the characteristic orifice dimension of the slit in the nozzle-forming component.

45. The system of claim 44, wherein the thickness of walls of the structure separating each of the channels is less than 0.002 inch.

46. The system of claim 45, wherein the thickness of walls of the structure separating each of the channels is less than 0.001 inch.

47. The system of claim 42, wherein the height of each of the channels as measured along a direction that is essentially perpendicular to the longitudinal axis of the main body portion of the air lance exceeds a characteristic dimension of each of the channels by a factor of at least about 2, the characteristic dimension of each of the channels being defined as the largest cross-sectional dimension of each of the channels as measured along a direction essentially parallel to the longitudinal axis of the main body portion of the air lance.

48. The system of claim 47, wherein the height of each of the channels as measured along a direction that is essentially perpendicular to the longitudinal axis of the main body portion of the air lance exceeds a characteristic dimension of each of the channels by a factor of at least about 3, the characteristic dimension of each of the channels being defined as the largest cross-sectional dimension of each of the channels as measured along a direction essentially parallel to the longitudinal axis of the main body portion of the air lance.

49. The system of claim 48, wherein the height of each of the channels as measured along a direction that is essentially perpendicular to the longitudinal axis of the main body portion of the air lance a characteristic dimension of each of the channels by a factor of at least about 4, the characteristic dimension of each of the channels being defined as the largest cross-sectional dimension of each of the channels as measured along a direction essentially parallel to the longitudinal axis of the main body portion of the air lance.

50. The system of claim 4, wherein the first distance does not exceed about 0.75 inch, when the system is in operation.

51. An air lance for directing a gas through a stencil and onto a surface of an embossable fabric for embossing the fabric comprising:

a conduit having at least one inlet opening therein; and at least one orifice forming at least one nozzle, the nozzle being constructed and positioned to direct a stream of the gas through the stencil and onto the embossable surface of the fabric, when the air lance is in operation, with the nozzle having a characteristic orifice dimension not exceeding 0.05 inch.

52. The air lance of claim 51, wherein the gas comprises air.

53. The air lance of claim 52, wherein the at least one nozzle has a characteristic orifice dimension not exceeding about 0.01 inch.

54. The air lance of claim 53, wherein the at least one nozzle has a characteristic orifice dimension not exceeding about 0.005 inch.

55. The air lance of claim 54, wherein the at least one nozzle has a characteristic orifice dimension not exceeding about 0.001 inch.

56. The air lance of claim 52, wherein the at least one nozzle has a characteristic orifice dimension not exceeding a maximum characteristic nozzle length of the nozzle.

57. The air lance of claim 52, wherein the conduit includes a main body portion having the at least one inlet opening in at least one end thereof and at least one outlet opening in a side wall of the main body portion, wherein the air lance includes a nozzle-forming component, which nozzle-forming component includes the at least one orifice therein forming the at least one nozzle, wherein the nozzle in the nozzle-forming component is in fluid communication with the outlet opening in the main body portion of the conduit and is constructed and positioned to direct a stream of air through the stencil and onto the embossable surface of the fabric, when the air lance is in operation, and wherein the nozzle forming component is shaped and positioned so that the nozzle in the nozzle-forming component is separated from a first surface of the stencil by a distance that is substantially less than a distance separating the first surface of the stencil and the outlet opening in the main body portion of the conduit, when the air lance is in operation.

58. The air lance of claim 52, wherein the at least one nozzle comprises an orifice in the shape of an elongated slit.

59. The air lance of claim 52, wherein the air lance includes at least one air redirecting element constructed and positioned with respect to the at least one nozzle so that the fractional amount of the stream of air directed through the stencil essentially perpendicular to the embossable surface of the fabric, when the air lance is in operation, is increased with respect to a fractional amount of a stream of air directed through the stencil essentially perpendicular to the embossable surface of the fabric by an essentially equivalent air lance, except not including the air redirecting element.

60. An air lance for directing a gas through a stencil and onto a surface of an embossable fabric for embossing the fabric comprising:

a conduit having at least one inlet opening therein; and at least one orifice forming at least one nozzle, the nozzle being constructed and positioned to direct a stream of the gas through the stencil and onto the embossable surface of the fabric, when the air lance is in operation, with the nozzle having a characteristic nozzle length exceeding a maximum characteristic orifice dimension of the nozzle by a factor of at least about 3.

61. The air lance of claim 60, wherein the gas comprises air.

62. The air lance of claim 61, wherein the maximum characteristic nozzle length of the nozzle exceeds the characteristic orifice dimension by a factor of at least about 4.

63. The air lance of claim 61, wherein the conduit includes an elongated main body portion and wherein the at least one orifice forming the at least one nozzle comprises at least one outlet opening in a side wall of the main body portion of the conduit.

64. The air lance of claim 63, wherein the elongated main body portion of the conduit includes a plurality of orifices comprising a plurality of nozzles.

65. The air lance of claim 64, wherein the plurality of orifices are essentially circular in shape.

66. The air lance of claim 63, wherein the elongated main body portion of the conduit includes an elongated slit comprising a slit-shaped nozzle.

67. The air lance of claim 66, wherein the elongated slit has a width that is essentially constant along its length.

68. The air lance of claim 66, wherein the conduit is tubular in shape having a first and a second end and having one inlet opening in the first end thereof with the second end thereof sealed, and wherein the width of the elongated slit varies along a length of the main body portion such that the width is greatest in a region of the slit closest to the first end of the conduit and smallest in a region of the slit closest to the sealed second end of the conduit.

69. The air lance of claim 63, wherein the characteristic nozzle length of the at least one nozzle is essentially equal to the wall thickness of the main body portion in which the at least one outlet opening is formed.

70. The air lance of claim 69, wherein the wall thickness does not exceed about ⅛ inch.

71. The air lance of claim 63, wherein the air lance includes at least one air redirecting element constructed and positioned with respect to the at least one nozzle so that the fractional amount of the stream of air directed through the stencil essentially perpendicular to the embossable surface of the fabric, when the air lance is in operation, is increased with respect to a fractional amount of a stream of air directed through the stencil essentially perpendicular to the embossable surface of the fabric by an essentially equivalent air lance, except not including the air redirecting element.

72. The air lance of claim 71, wherein the at least one air redirecting element is positioned inside the main body portion of the conduit.

73. The air lance of claim 72, wherein a substantial fraction of the characteristic nozzle length of the at least one nozzle comprises a length of the at least one air redirecting element as measured in a direction essentially perpendicular to a longitudinal axis of the main body portion of the conduit.

74. The air lance of claim 61, wherein the conduit includes a main body portion having the at least one inlet opening in at least one end thereof and at least one outlet opening in a side wall of the main body portion, wherein the air lance includes a nozzle-forming component, which nozzle-forming component includes the at least one orifice therein forming the at least one nozzle, wherein the nozzle in the nozzle-forming component is in fluid communication with the outlet opening in the main body portion of the conduit and is constructed and positioned to direct a stream of air through the stencil and onto the embossable surface of the fabric, when the air lance is in operation, and wherein the nozzle forming component is shaped and positioned so that the nozzle in the nozzle-forming component is separated from a first surface of the stencil by a distance that is substantially less than a distance separating the first surface of the stencil and the outlet opening in the main body portion of the conduit, when the air lance is in operation.

75. An air lance for directing a gas through a stencil and onto a surface of an embossable fabric for embossing the fabric comprising:

an elongated tubular conduit having at least one inlet opening therein and at least one internal support strut attached therein, which support strut is constructed and positioned within the conduit to resist expansion of the conduit when the air lance is in operation; and at least one orifice in the shape of an elongated slit forming at least one nozzle, the nozzle being constructed and positioned to direct a stream of the gas through at least one opening in the stencil and onto the embossable surface of the fabric, when the air lance is in operation.

76. The air lance of claim 75, wherein the gas comprises air.

77. A method for embossing a surface of an embossable fabric with a gas comprising:

supplying a flow of the gas to an air lance;

flowing a stream of the gas through at least one nozzle of the air lance so that essentially the entire stream of the gas is directed towards a surface of a stencil facing and adjacent the nozzle at an angle of at least about 63 degrees with respect to a longitudinal axis of the air lance;

passing the stream of the gas through at least one opening in the stencil; and impinging the stream of the gas onto the embossable surface of the fabric, thereby embossing the embossable surface of the fabric.

78. The method of claim 77, wherein the gas comprises air.

79. The method of claim 78, wherein during the flowing step the at least one nozzle is positioned so that at least a portion thereof is separated from the surface of the stencil facing and adjacent the nozzle by a distance not exceeding about 0.75 inch, such that the stream of air includes at least a portion thereof with a length between the nozzle and the surface of the stencil not exceeding 0.75 inch.

80. The method of claim 79, wherein during the flowing step the at least one nozzle is positioned so that at least a portion thereof is separated from the surface of the stencil facing and adjacent the nozzle by a distance not exceeding about 0.0125 inch, such that the stream of air includes at least a portion thereof with a length between the nozzle and the surface of the stencil not exceeding 0.0125 inch.

81. The method of claim 80, wherein during the flowing step the velocity of air exiting the at least one nozzle is at least about 12,000 feet per minute.

82. The method of claim 81, wherein during the flowing step the at least one nozzle through which the stream of air flows has a characteristic orifice dimension not exceeding 0.2 inch.

83. The method of claim 82, wherein during the impinging step at least a portion of a fabric-facing surface of the stencil is positioned from the embossable surface of the fabric at a distance not exceeding about 0.02 inch.

84. The method of claim 83, wherein during the flowing step the stream of air flows through a nozzle-forming component removably connected to a main body portion of the air lance, wherein the nozzle-forming component includes at least one orifice therein forming the at least one nozzle, wherein the nozzle is in fluid communication with at least one outlet opening in the main body portion, and wherein the nozzle forming component is shaped and positioned so that the nozzle in the nozzle-forming component is separated from the surface of the stencil facing and adjacent the nozzle by a distance that is substantially less than a distance separating the surface of the stencil facing and adjacent the nozzle and the outlet opening in the main body portion of the air lance.

85. The method of claim 84, wherein the at least one orifice forming the at lest one nozzle in the nozzle-forming component comprises an elongated slit.

86. The method of claim 85, wherein the nozzle forming component includes at least one air redirecting element therein and wherein prior to the flowing step at least a portion of the flow of air supplied to the air lance impinges upon and is redirected by the air redirecting element.

87. The method of claim 86, wherein during the flowing step the velocity of the air stream flowing through the at least one nozzle is essentially constant along essentially the entire length a region of the air lance along which the nozzle is positioned.

88. A system for embossing a surface of an embossable fabric with a gas comprising:

an elongated conduit extending across and substantially parallel to the embossable fabric;

means for redirecting gas flow flowing along the length of the conduit so that essentially all of the gas flow exits from at least one outlet opening in the conduit towards the fabric in a direction making an angle of at least about 45 degrees with respect to the longitudinal axis of the elongated conduit, with said means comprising a series of baffles shaped and positioned to intercept and deflect the gas flow.

89. The system of claim 88, wherein the gas comprises air and the gas flow comprises an air flow.

90. A method for embossing a surface of an embossable fabric with a gas comprising:

directing a stream of the gas through a stencil and onto the embossable surface of the fabric with an air lance including a conduit, having at least one inlet opening therein, and at least one orifice forming at least one nozzle having a characteristic orifice dimension not exceeding 0.05 inch.

91. The method of claim 90, wherein the gas comprises air.

92. A method for embossing a surface of an embossable fabric with a gas comprising:

directing a stream of the gas through a stencil and onto the embossable surface of the fabric with an air lance including a conduit, having at least one inlet opening therein, and at least one orifice forming at least one nozzle having a characteristic nozzle length exceeding a maximum characteristic orifice dimension of the nozzle by a factor of at least about 3.

93. The method of claim 92, wherein the gas comprises air.

94. A method for embossing a surface of an embossable fabric with a gas comprising:

directing a stream of the gas through a stencil and onto the embossable surface of the fabric with an air lance including an elongated tubular conduit, having at least one inlet opening therein, at least one internal support strut attached therein, which support strut is constructed and positioned within the conduit to resist expansion of the conduit when the air lance is in operation, and at least one orifice in the shape of an elongated slit forming at least one nozzle.

95. The method of claim 94, wherein the gas comprises air.

96. A method for embossing a surface of an embossable fabric with a gas comprising:

directing a stream of the gas through a stencil and onto the embossable surface of the fabric with an air lance including a conduit, having at least one inlet opening therein, at least one orifice forming at least one nozzle, and at least one air redirecting element constructed and positioned with respect to the nozzle so that the fractional amount of the stream of the gas directed through the stencil essentially perpendicular to the embossable surface of the fabric is increased with respect to a fractional amount of a stream of the gas directed through the stencil essentially perpendicular to the embossable surface of the fabric by an essentially equivalent air lance, except not including the air redirecting element.

97. The method of claim 96, wherein the gas comprises air.

* * * * *

UNITED STATES PATENT AND TRADEMARK OFFICE

CERTIFICATE OF CORRECTION

PATENT NO. : 6,770,240 B1
DATED : August 3, 2004
INVENTOR(S) : William Laird et al.

It is certified that error appears in the above-identified patent and that said Letters Patent is hereby corrected as shown below:

Column 35,
Line 37, please replace “at the” with -- the at --

Column 40,
Line 15, please replace “a” with -- of a --

Signed and Sealed this

Thirtieth Day of November, 2004

JON W. DUDAS
*Director of the United States Patent and Trademark Office*